US008852838B2

(12) United States Patent
Kamiwaki et al.

(10) Patent No.: US 8,852,838 B2
(45) Date of Patent: Oct. 7, 2014

(54) ELECTROSTATIC CHARGE IMAGE DEVELOPING TONER, ELECTROSTATIC CHARGE IMAGE DEVELOPER, TONER CARTRIDGE, PROCESS CARTRIDGE, IMAGE FORMING APPARATUS, AND IMAGE FORMING METHOD

(75) Inventors: Satoshi Kamiwaki, Kanagawa (JP); Akira Matsumoto, Kanagawa (JP); Yukiaki Nakamura, Kanagawa (JP); Masanobu Ninomiya, Kanagawa (JP); Yusuke Ikeda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/565,392

(22) Filed: Aug. 2, 2012

(65) Prior Publication Data

US 2013/0252156 A1 Sep. 26, 2013

(30) Foreign Application Priority Data

Mar. 26, 2012 (JP) ..... 2012-069955
Mar. 26, 2012 (JP) ..... 2012-070217

(51) Int. Cl.
*G03G 9/087* (2006.01)

(52) U.S. Cl.
USPC ..... 430/109.4; 430/108.4; 430/108.7; 399/252

(58) Field of Classification Search
USPC ..... 430/108.4, 108.7, 109.4; 399/252
See application file for complete search history.

(56) References Cited

U.S. PATENT DOCUMENTS

2006/0115758 A1* 6/2006 Chang et al. ..... 430/109.4
2009/0053638 A1* 2/2009 Fukushima ..... 430/105
2009/0233206 A1* 9/2009 Lee et al. ..... 430/108.11
2009/0286176 A1* 11/2009 Ohmura et al. ..... 430/107.1
2011/0300477 A1* 12/2011 Yoshida et al. ..... 430/105

FOREIGN PATENT DOCUMENTS

JP 2001-305789 * 11/2001 ..... G03G 9/087
JP A-2001-305789 11/2001

OTHER PUBLICATIONS

Translation of JP 2001-305789 published Nov. 2001.*

* cited by examiner

*Primary Examiner* — Peter Vajda
(74) *Attorney, Agent, or Firm* — Oliff PLC

(57) ABSTRACT

An electrostatic charge image developing toner includes toner particles that contain a binder resin having a carboxyl group, in which the carboxyl group in the binder resin present on the surfaces of the toner particles forms an alkaline earth metal salt, and an amount of the alkaline earth metal which is detected through ion chromatography of the toner particles is in a range of from $1.00\times10^{-10}$ mol/g to $0.90\times10^{-6}$ mol/g.

19 Claims, 2 Drawing Sheets

ELECTROSTATIC CHARGE IMAGE DEVELOPING TONER, ELECTROSTATIC CHARGE IMAGE DEVELOPER, TONER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Applications No. 2012-069955 and No. 2012-070217 both filed Mar. 26, 2012.

BACKGROUND

1. Technical Field

The present invention relates to an electrostatic charge image developing toner, an electrostatic charge image developer, a toner cartridge, a process cartridge, an image forming apparatus, and an image forming method.

2. Related Art

A method of visualizing image information through an electrostatic charge image, such as electrophotography, is now being used in a variety of fields. In electrophotography, an electrostatic charge image is formed on a photoreceptor through charging and exposure (forming the electrostatic charge image), the electrostatic charge image is developed using a developer including a toner, and visualized through transferring and fixing.

SUMMARY

According to an aspect of the invention, there is provided an electrostatic charge image developing toner including toner particles that contain a binder resin having a carboxyl group, wherein the carboxyl group in the binder resin present on surfaces of the toner particles forms an alkaline earth metal salt, and an amount of the alkaline earth metal which is detected through ion chromatography of the toner particles is in a range of from $1.00\times10^{-10}$ mol/g to $0.90\times10^{-6}$ mol/g.

BRIEF DESCRIPTION OF THE DRAWINGS

Exemplary embodiments of the present invention will be described in detail based on the following figures, wherein.

DETAILED DESCRIPTION

Figure 1:
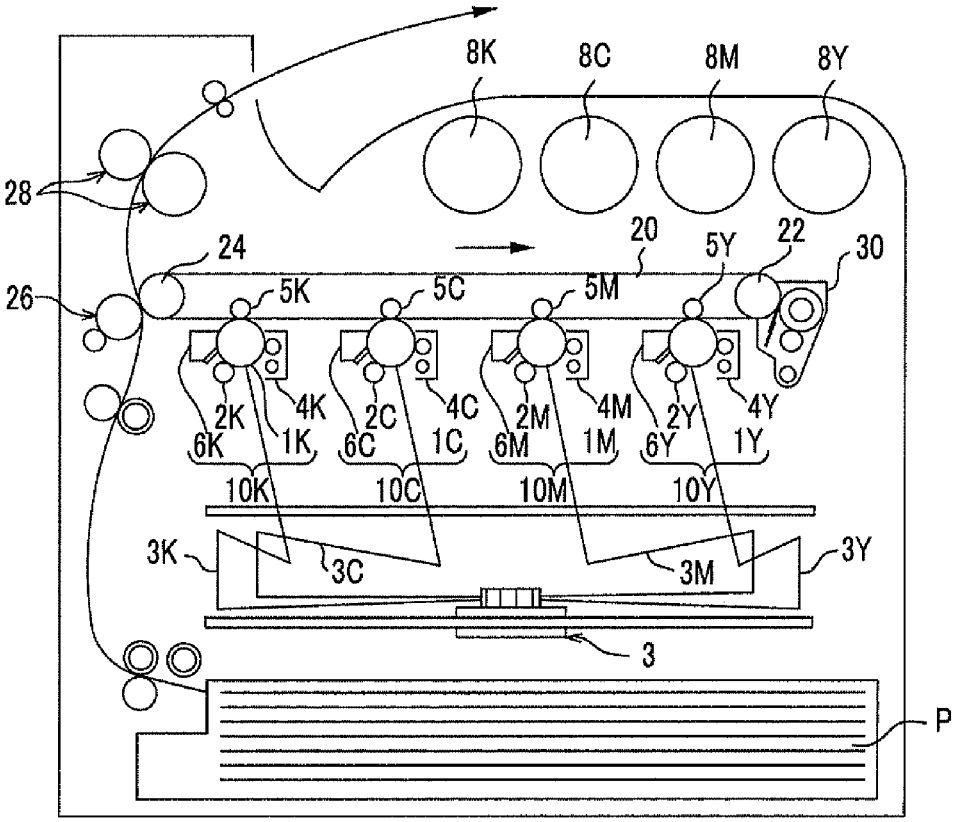
FIG. 1 is a schematic configuration view showing an example of an image forming apparatus of the present exemplary embodiment.

Hereinafter, the electrostatic charge image developing toner, electrostatic charge image developer, toner cartridge, process cartridge, image forming apparatus and image forming method of the invention will be described in detail.

Electrostatic Charge Image Developing Toner

The electrostatic charge image developing toner of the exemplary embodiment (hereinafter sometimes referred to as the toner of the exemplary embodiment) is a toner including toner particles that contain a binder resin having a carboxyl group, in which the carboxyl group included in the binder resin present on the surfaces of the toner particles and an alkaline earth metal form a salt, and the amount of the alkaline earth metal in the toner particles which is detected through ion chromatography is in a range of from $1.00\times10^{-10}$ mol/g to $0.90\times10^{-6}$ mol/g.

In an exemplary embodiment of the invention, the alkaline earth metal refers to calcium, strontium, and barium.

There is a case in which the carboxyl group included in the binder resin present on the surfaces of the toner particles absorbs moisture so as to generate protons, and thus generates the charge environment dependency of the toner. Therefore, it is preferable that a salt be formed between the carboxyl group and the alkaline earth metal so that the toner becomes insoluble, and the environment dependency due to moisture absorption is suppressed.

In the toner of the exemplary embodiment, it is observed that, since the amount of the alkaline earth metal which is detected through ion chromatography is in a range of from $1.00\times10^{-10}$ mol/g to $0.90\times10^{-6}$ mol/g, an appropriate amount of the alkaline earth metal may be disposed on the toner surface, deterioration of the fluidity of the toner caused by the moisture absorption of the remaining alkaline earth metal salt is suppressed, and occurrence of density unevenness is suppressed.

In the exemplary embodiment, when the amount of the alkaline earth metal which is detected through ion chromatography of the toner particles is less than $1.00\times10^{-10}$ mol/g, the amount of the salt being formed is insufficient, and there is a case in which the effects of the invention cannot be sufficiently obtained.

On the other hand, when the amount of the alkaline earth metal which is detected through ion chromatography of the toner particles exceeds $0.90\times10^{-6}$ mol/g, there is a case in which the problem of density unevenness in an image caused by the remaining unreacted alkaline earth metal occurs.

In the exemplary embodiment, the amount of the alkaline earth metal which is detected through ion chromatography of the toner particles is preferably in a range of from $1.00\times10^{-9}$ mol/g to $0.50\times10^{-6}$ mol/g.

In addition, in the exemplary embodiment, whether or not the carboxyl group and the alkaline earth metal form a salt is confirmed by the following method.

Whether or not the carboxyl group and the alkaline earth metal form a salt is confirmed by confirming whether or not carboxyl group-derived oxygen forms an alkaline earth metal salt through XPS measurement of the toner.

Hereinafter, the respective components that compose the toner of the exemplary embodiment will be described.

The toner of the exemplary embodiment includes toner particles containing a binder resin having a carboxyl group. The toner particles may contain a colorant, a release agent, and other additives as necessary. In addition, an external additive may be added to the toner particles.

The kind of the binder resin that is used in the exemplary embodiment is a resin including at least one or more kinds of carboxylic acids in the raw material. Specific examples of the carboxylic acid include acrylic acid, methacrylic acid, fumaric acid, maleic acid, cinnamic acid, and the like. Specific examples of the binder resin that may be used include homopolymers of a monomer having a carboxyl group, such as acrylic acid or methacrylic acid, copolymers obtained by copolymerizing with other monomer as necessary, mixtures thereof, and the like, and, specifically, a non-vinyl condensation-based resin, such as a polyester resin, a polyurethane resin, a cellulose resin, or a polyether resin, may be used.

Among the above, a polyester resin is preferably used as the binder resin from the viewpoint of fixing properties.

The kind of the polyester resin is not particularly limited, and a well-known crystalline polyester resin or an amorphous polyester resin may be used. A crystalline polyester resin and an amorphous polyester resin may be jointly used.

Crystalline Polyester Resin

In the exemplary embodiment, a crystalline polyester resin may be used since an abrupt change in viscosity due to heating is more frequently exhibited, and, furthermore, both mechanical strength and low-temperature fixing properties are satisfied.

Here, the "crystalline" in the crystalline polyester resin indicates that the polyester resin does not show a stair-like change in the heat absorption amount, and has a clear endothermic peak in differential scanning calorimetry measurement (DSC), and specifically means that the half-value width of the endothermic peak is 10(° C.) or less when measured at a temperature-rise rate of 10(° C./min). On the other hand, a resin having a half-value width of more than 10° C. or a resin for which a clear endothermic peak is not observed refers to an amorphous polyester resin (amorphous polymer).

In addition, as a polymerizable monomer component that composes the crystalline polyester resin, a polymerizable monomer having a linear fatty component rather than a polymerizable monomer having an aromatic component is preferable since a crystalline structure is easily formed. Furthermore, in order to prevent impairing of crystallinity, each of polymerizable monomer-derived components being composed is preferably included at 30 mol % or more singly in a polymer.

The melting temperature of the crystalline polyester resin that is used in the exemplary embodiment is preferably in a range of from 50° C. to 100° C., more preferably in a range of from 55° C. to 90° C., and still more preferably in a range of from 60° C. to 85° C. an terms of storage properties and low-temperature fixing properties. When the melting temperature is below 50° C., there is a case in which the storage properties of a toner or the storage properties of fixed images after fixing become poor like occurrence of blocking in a toner under storage. In addition, in a case in which the melting temperature exceeds 100° C., there is a case in which sufficient low-temperature fixing properties cannot be obtained.

Meanwhile, the melting temperature of the crystalline polyester resin is obtained as a peak temperature of the endothermic peak obtained through the differential scanning calorimetry (DSC).

In the exemplary embodiment, the "crystalline polyester resin" also refers to a polymer (copolymer) obtained by polymerizing a component that composes polyester and other component together with a polymer for which 100% of the components have a polyester structure. However, in the latter case, the component other than polyester that composes the polymer (copolymer) is at 50% by weight or less.

The crystalline polyester resin that is used for the toner of the exemplary embodiment is synthesized from, for example, a polyvalent carboxylic acid component and a polyol component. Meanwhile, in the exemplary embodiment, as the crystalline polyester resin, a commercially available product may be used, or a synthesized product may be used.

Examples of the polyvalent carboxylic acid component include fatty dicarboxylic acids, such as oxalic acid, succinic acid, glutaric acid, adipic acid, asperic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; aromatic dicarboxylic acids, such as diacids of phthalic acid, isophthalic acid, terephthalic acid, naphthalene-2,6-dicarboxylic acid, malonic acid, and mesaconic acid; and the like. Furthermore, the examples also include anhydrides of the above and lower alkyl esters of the above, but the polyvalent carboxylic acid component is not limited thereto.

Examples of tri- or more valent carboxylic acid include specific aromatic carboxylic acids, such as 1,2,3-benzene tricarboxylic acid, 1,2,4-benzene tricarboxylic acid, and 1,2,4-naphthalene tricarboxylic acid, anhydrides of the above, lower alkyl esters of the above, and the like. The tri- or more valent carboxylic acid may be used singly, or two or more kinds thereof may be jointly used.

In addition, as the acid component, a dicarboxylic acid component having a sulfonic acid group may be included as well as the fatty dicarboxylic acid or the aromatic dicarboxylic acid.

Furthermore, a dicarboxylic acid component having a double bond may be included as well as the fatty dicarboxylic acid or the aromatic dicarboxylic acid.

As the polyol component, a fatty diol is preferable, and a linear fatty dial having 7 to 20 carbon atoms in the main chain portion is more preferable. In a branched fatty diol, there is a case in which the crystallinity of the polyester resin deteriorates, and the melting temperature lowers. In addition, when less than 7 carbon atoms are present in the main chain portion, in a case in which the polyol component is condensation-polymerized with an aromatic dicarboxylic acid, there is a case in which the melting temperature increases, and low-temperature fixing becomes difficult. On the other hand, when more than 20 carbon atoms are present in the main chain portion, it becomes liable to be difficult to practically procure the material. The number of carbon atoms in the main chain portion is preferably 14 or less.

Specific examples of the fatty dial that is preferably used for synthesis of the crystalline polyester that is used for the toner of the exemplary embodiment include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,14-eicosanedecanediol, and the like, but the fatty dial is not limited thereto. Among the above, 1,8-octanediol, 1,9-nonanediol, and 1,10-decanediol are preferable in consideration of easy procurement.

Examples of the tri- or more valent alcohol include glycerin, trimethylolethane, trimethylolpropane, pentaerythritol, and the like. The tri- or more valent alcohol may be used singly, or two or more kinds thereof may be jointly used.

In the polyol component, the content of the fatty diol is preferably 80 mol % or more, and more preferably 90 mol % or more. When the content of the fatty diol is less than 80 mol %, since the crystallinity of the polyester resin lowers, and the melting temperature lowers, there is a case in which toner blocking resistance, image storage properties, and low-temperature fixing properties deteriorate.

Meanwhile, for the purpose of adjusting the acid value or the hydroxyl value, the polyvalent carboxylic acid or the polyol may be added at the final phase of synthesis as necessary. Examples of the polyvalent carboxylic acid include aromatic carboxylic acids, such as terephthalic acid, isophthalic acid, anhydrous phthalic acid, trimellitic anhydride, pyromellitic acid, and naphthalene dicarboxylic acid; fatty carboxylic acids, such as maleic anhydride, fumaric acid, succinic acid, alkenyl succinic anhydride, and adipic acid; alicyclic carboxylic acids, such as cyclohexane dicarboxylic acid; aromatic carboxylic acids having at least 3 carboxyl groups in one molecule, such as 1,2,4-benzene tricarboxylic acid, 1,2,5-benzene tricarboxylic acid, and 1,2,4-naphthalene tricarboxylic acid; and the like.

Examples of the polyol include fatty diols, such as ethylene glycol, diethylene glycol, triethylene glycol, propylene glycol, butanediol, hexanediol, neopentyl glycol, and glycerin; alicyclic diols, such as cyclohexanediol, cyclohexanedimethanol, and hydrogenated biphenol A; aromatic diols, such as ethylene oxide adducts of bisphenol A and propylene oxide adducts of bisphenol A; and the like.

The crystalline polyester resin may be manufactured at a polymerization temperature set to from 180° C. to 230° C., and, as necessary, the reaction system is depressurized, and the reaction is caused while removing water or alcohol generated during condensation.

In a case in which the polymerizable monomer is not soluble or compatible at the reaction temperature, a solvent having a high boiling point may be added as a solubilizing agent to solve the polymerizable monomer. In this case, the condensation polymerization reaction is caused while distilling the solubilizing agent. In a case in which a poorly compatible polymerizable monomer is present during a copolymerization reaction, the poorly compatible polymeriable monomer and an acid or an alcohol that is to be condensation-polymerized with the polymerizable monomer may be condensed in advance, and then condensation-polymerized with main components.

A catalyst that may be used for manufacturing of the polyester resin includes alkali metal compounds, such as sodium and lithium; alkaline earth metal compounds, such as magnesium and calcium; metal compounds, such as zinc, manganese, antimony, titanium, tin, zirconium, and germanium; phosphite compounds; phosphate compounds, amine compounds; and the like.

Specific examples include compounds, such as sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenylantimony, tributylantimony, tin formate, tin oxalate, tetraphenyltin, dibutyltin dichloride, dibutyltin oxide, diphenyltin oxide, zirconium tetrabutoxide, zirconium naphthenate, zirconyl carbonate, zirconyl acetate, ziconyl stearate, zirconyl octylate, germanium oxide, triphenyl phosphite, tris(2,4-di-t-butylphenyl)phosphite, ethyl triphenylphosphonium bromide, triethylamine and triphenylamine.

The weight average molecular weight (Mw) of the crystalline polyester resin is preferably from 6,000 to 35,000. When the molecular weight (Mw) is less than 6,000, there is a case in which a toner is penetrated in the surface of a recording medium, such as paper, during fixing so as to cause fixing unevenness, or the strength with respect to the bending resistance of a fixed image lowers. In addition, when the weight average molecular weight (Mw) exceeds 35,000, there is a case in which the viscosity increases excessively during melting so as to increase the temperature at which an appropriate viscosity reaches, and, consequently, there is a case in which the low-temperature fixing properties are impaired.

The weight average molecular weight may be measured through gel permeation chromatography (GPC). For measurement of the molecular weight through GPC, a GPC•HLC-8120 manufactured by Tosoh Corporation is used as a measurement apparatus, a TSKgel Super HM-M (15 cm) manufactured by Tosoh Corporation is used as a column, and a THF solvent is used. The weight average molecular weight is a value calculated using a molecular weight calibration curve that is prepared from the measurement results using monodisperse polystyrene standard samples.

The content of the crystalline polyester resin is preferably in a range of from 3% by weight to 40% by weight, more preferably in a range of from 4% by weight to 35% by weight, and still more preferably in a range of from 5% by weight to 30% by weight.

The above crystalline polyester resin preferably includes a polyester resin synthesized using the fatty polymerizable monomer (hereinafter sometimes referred to as the "crystalline fatty polyester resin") as the main component (50% by weight or more). Furthermore, in this case, the composition proportion of the fatty polymerizable monomer that composes the crystalline fatty polyester resin is preferably 60 mol % or more, and more preferably 90 mol % or more. Meanwhile, as the fatty polymerizable monomer, the fatty dials or the dicarboxylic acids as described above are preferably used.

Amorphous Polyester Resin

In the exemplary embodiment, since use of an amorphous polyester resin improves the compatibility with the crystalline polyester resin, the viscosity of the amorphous polyester resin also decreases as the viscosity of the crystalline polyester resin decreases at the melting point, and sharp melting properties (sensitive melting characteristics) appropriate as a toner are obtained, which is beneficial for the low-temperature fixing properties. In addition, since the wetting properties with the crystalline polyester resin are favorable, the dispersibility of the crystalline polyester resin in the toner improves, and exposure of the crystalline polyester resin to the surface of the toner is suppressed, whereby adverse influences on the charging properties are suppressed. In addition, use of the amorphous polyester resin is preferably for the above reasons from the viewpoint of improvement in the strength of the toner or the strength of fixed images.

Examples of the amorphous polyester resin that is preferably used in the exemplary embodiment include resins obtained through condensation-polymerization of a polyvalent carboxylic acid and a polyol.

Examples of the polyvalent carboxylic acid include aromatic carboxylic acids, such as terephthalic acid, isophthalic acid, phthalic anhydride, trimellitic anhydride, pyromellitic acid, and naphthalene dicarboxylic acid; fatty carboxylic acids, such as maleic anhydride, fumaric acid, succinic acid, alkenyl succinic anhydride, and adipic acid; and alicyclic carboxylic acids, such as cyclohexane dicarboxylic acid, and the polyvalent carboxylic acid may be used in one kind or two or more kinds thereof. Among the polyvalent carboxylic acids, use of the aromatic carboxylic acid is preferable. In addition, use of a tri- or more valent carboxylic acid (trimellitic acid, anhydrides thereof, or the like) jointly with a dicarboxylic acid for having a crosslinked structure or a branched structure is preferable in order to secure favorable fixing properties.

Examples of the polyol in the amorphous polyester resin include fatty dials, such as ethylene glycol, diethylene glycol, triethylene glycol, propylene glycol, butanediol, hexanediol, neopentyl glycol, and glycerin; alicyclic diols, such as cyclohexanediol, cyclohexanedimethanol, and hydrogenated biphenol A; aromatic diols, such as ethylene oxide adducts of bisphenol A and propylene oxide adducts of bisphenol A; and the like. The polyol may be used in one kind or two or more kinds thereof. Among the polyols, the aromatic diols and the alicyclic dials are preferable, and, among them, the aromatic dials are more preferable. In addition, a tri- or more valent polyol (glycerin, trimethylopropane, or pentaerythritol) may be jointly used with a dial for having a crosslinked structure or a branched structure in order to secure more favorable fixing properties.

The glass transition temperature (Tg) of the amorphous polyester resin is preferably in a range of from 50° C. to 80° C. When the Tg is lower than 50° C., there is a case in which a problem occurs with the storage properties of the toner or the storage properties of fixed images. In addition, when the Tg is higher than 80° C., there is a case in which it becomes impossible for the toner to be fixed at a temperature lower than in the related art.

The Tg of the amorphous polyester resin is more preferably in a range of from 50° C. to 65° C.

Meanwhile, the glass transition temperature of the amorphous polyester resin is obtained as a peak temperature of the endothermic peak obtained through the differential scanning calorimetry (DSC).

In measurement of the molecular weight of tetrahydrofuran (THF) soluble by the gel permeation chromatography (GPC), the amorphous polyester resin has a weight average molecular weight (Mw) of preferably from 5,000 to 1,000,000, and more preferably from 7,000 to 500,000, a number average molecular weight (Mn) of preferably from 2,000 to 100,000, and a molecular weight distribution Mw/Mn of preferably from 1.5 to 100 and still more preferably from 2 to 60.

The content of the amorphous polyester resin is preferably in a range of from 40% by weight to 95% by weight, more preferably in a range of from 50% by weight to 90% by weight, and still more preferably in a range of from 60% by weight to 85% by weight.

Meanwhile, the amorphous polyester resin may be manufactured in a similar manner to the crystalline polyester resin.

The acid value of the binder resin that is used in the exemplary embodiment (the mg value of KOH necessary to neutralize 1 g of the resin) is preferably in a range of from 1.0 mg KOH/g to 50.0 mg KOH/g, more preferably in a range of from 2.0 mg KOH/g to 40.0 mg KOH/g, and still more preferably in a range of from 3.0 mg KOH/g to 30.0 mg KOH/g.

Meanwhile, in the exemplary embodiment, the acid value is measured based on JIS K-0070-1992.

When the acid value of the binder resin is 1 mg KOH/g or more, a carboxyl group necessary for an alkaline earth metal treatment is sufficiently present, and favorable fluidity may be obtained. On the other hand, when the acid value of the binder resin is 50 mg KOH/g or less, an alkaline earth metal-treated carboxyl group is rarely present, and favorable fluidity may be obtained.

The toner of the exemplary embodiment may include a colorant.

The colorant may be a dye or a pigment, but a pigment is preferably from the viewpoint of light resistance and water resistance.

Specific examples of the colorant that may be used include well-known pigments, such as carbon black, aniline black, aniline blue, chalco oil blue, chromium yellow, ultramarine blue, DuPont oil red, quinolone yellow, methylene blue chloride, phthalocyanine blue, malachite green oxalate, lamp black, rose Bengal, quinacridone, benzidine yellow, C. I. pigment red 48:1, C. I. pigment red 57:1, C. I. pigment red 122, C. I. pigment red 185, C. I. pigment red 238, C. I. pigment yellow 12, C. I. pigment yellow 17, C. I. pigment yellow 180, C. I. pigment yellow 97, C. I. pigment yellow 74, C. I. pigment blue 15:1, C. I. pigment blue 15:3, and the like.

In the toner of the exemplary embodiment, the content of the colorant is preferably from 1 part by weight to 30 parts by weight with respect to 100 parts by weight of the binder resin.

Use of a surface-treated colorant or use of a pigment dispersion agent as necessary is also effective. A yellow toner, a magenta toner, a cyan toner, a black toner, or the like is obtained depending on selection of the kind of the colorant.

The toner of the exemplary embodiment may contain a release agent.

The release agent being used may be a substance having a melting temperature of 70° C. to 100° C. in a DSC curve measured based on JIS K 7121-1987 "Testing methods for transition temperatures of plastics." Meanwhile, the peak temperature in the DSC curve is used as the melting temperature.

In the DSC curve measured through differential scanning calorimetry, the release agent has a melting temperature of preferably 70° C. or higher, and more preferably 80° C. or higher since the release agent promptly exudes between a fixed image and a fixing member, such as a fixing roll, so that the surface of the fixed image may be more flattened, and, consequently, a high-gloss image may be obtained. The endothermic onset temperature varies by the kind and amount of a polar group having a low molecular weight or a polar group having a structure thereof in the molecular weight distribution of molecules that compose the release agent.

Generally, the endothermic onset temperature as well as the melting temperature increases as the molecular weight increases, but increasing the molecular weight impairs the original low melting temperature and low viscosity of a wax (release agent). Therefore, it is effective to select and remove only low molecular weight molecules in the molecular weight distribution of the wax, and a method therefor includes methods of molecular distillation, solvent classification, gas chromatograph classification, and the like.

Specific examples of the release agent include hydrocarbon waxes, such as polyethylene wax, polypropylene wax, and polybutylene wax, paraffin wax; silicone that shows the softening point through heating, fatty amides, such as oleic amide, erucamide, ricinoleic amide, and stearic acid amide; plant waxes, such as carnauba wax, rice wax, candelilla wax, Japan wax, and jojoba oil; animal waxes, such as beeswax; ester waxes, such as fatty ester and montan acid ester; mineral and oil waxes, such as montan wax, ozokerite, ceresin, microcrystalline wax, and Fischer-Tropsch wax; denatured products thereof, and the like.

In the exemplary embodiment, the melting temperature of the release agent is preferably from 70° C. to 100° C., and more preferably from 80° C. to 100° C.

The added amount of the release agent is preferably from 1 part by weight to 15 parts by weight, and more preferably from 3 part by weight to 10 parts by weight with respect to 100 parts by weight of the binder resin. When the added amount is 1 part by weight or more, the effect of addition of the release agent is exhibited. In addition, when the added amount is 15 parts by weight or less, the toner is prevented from extremely degrading in terms of the fluidity of the toner, and the charging distribution is prevented from extremely widening.

Other Additives

To the toner particles of the exemplary embodiment, a variety of components, such as an internal additive, a charge-controlling agent, inorganic powder (inorganic particles), and organic particles, may be added as necessary in addition to the above components.

Examples of the internal additive include magnetic materials, such as metals of ferrite, magnetite, reduced iron, cobalt, nickel, manganese, and the like, alloys, and compounds including the metals.

Examples of the charge-controlling agent include quaternary ammonium salt compounds, nigrosine compound, dyes including a complex, such as aluminum, iron, or chromium, triphenyl methane pigments, and the like.

The inorganic particles are added for a variety of purposes, and may be added for adjustment of the viscoelasticity of the toner. The adjustment of the viscoelasticity adjusts image glossiness or penetrating into paper. As the inorganic particles, well-known inorganic particles, for example, silica particles, titanium oxide particles, alumina particles, cerium oxide particles, the above whose surfaces is hydrophobized, and the like may be used singly or in combination of two or more kinds thereof, but silica particles having a smaller refractive index than that of the binder resin are preferably used from the viewpoint of unimpaired transparency, such as chromogenic properties or OHP permeability. In addition, a variety of surface treatments may be carried out on silica particles, and silica particles that have undergone a surface treatment using, for example, a silane coupling agent, a titanium coupling agent, silicone oil, or the like may be preferably used.

As a method of manufacturing the toner particles of the exemplary embodiment, a kneading and pulverizing method, a wet granulation method, or the like, which are generally used, may be used. Here, the wet granulation method includes a suspension polymerization method, an emulsion aggregation method, an emulsion polymerization aggregation method, a soap-free emulsion polymerization method, a non-aqueous dispersion polymerization method, an in-situ polymerization method, an interface polymerization method, an emulsion dispersion granulation method, an aggregation and coalescence method, and the like.

In order to manufacture the toner by the kneading and pulverizing method, the binder resin, the colorant, the release agent, and the like are melted and kneaded using, for example, a pressurization kneader, a roll mill, an extruder, or the like so as to be dispersed, cooled, then, pulverized into fine powder using a jet mill or the like, and classified using a classifier, for example, a wind classifier. Toner particles having a desired particle diameter are obtained by undergoing the above processes.

In addition, the wet granulation method preferably includes well-known methods, such as a melting suspension method, an emulsion aggregation method, or a dissolution suspension method. Hereinafter, the emulation aggregation method will be used as an example for description.

The emulsion aggregation method is a manufacturing method including a process in which aggregated particles are formed in a dispersion liquid having resin particles (hereinafter sometimes referred to as the "emulsified liquid") dispersed therein so as to prepare an aggregated particle dispersion liquid (an aggregation process) and a process in which the aggregated particle dispersion liquid is heated so as to coalesce the aggregated particles (a coalescence process). In addition, a process in which the aggregated particles are dispersed (a dispersion process) and a process in which a particle dispersion liquid having particles dispersed therein is added to and mixed with the aggregated particle dispersion liquid so as to attach particles to the aggregated particles, thereby forming attached particles (an attaching process) may be provided before the aggregation process and between the aggregation process and the coalescence process respectively. In the attaching process, the particle dispersion liquid is added to and mixed with the aggregated particle dispersion liquid prepared in the aggregation process so as to attach the particles to the aggregated particles, thereby forming attached particles, but the added particles are particles newly added to the aggregated particles from the viewpoint of the aggregated particles, and thus, sometimes, termed "added particles."

As the added particles, release agent particles, colorant particles, or the like may be used singly or in combination of plural particles as well as the resin particles. The method of adding and mixing the particle dispersion liquid is not particularly limited, and, for example, the particle dispersion liquid may be added and mixed slowly and continuously or in a step-by-step manner over plural divided times. A pseudo shell structure may be formed by providing the attaching process.

In the toner, a core shell structure is preferably formed through an operation in which the added particles are added. The binder resin as the main component of the added particles is a resin for a shell layer. When the above method is used, the toner shape may be simply controlled through adjustment of temperature, number of stirrings, pH, and the like in the coalescence process.

In the emulsion aggregation method, a binder resin dispersion liquid is used. Meanwhile, the emulsion aggregation method more preferably includes an emulsification process in which the binder resin is emulsified so as to form emulsified particles (liquid droplet).

In the emulsification process, the emulsified particles (liquid droplet) of the binder resin are preferably formed by supplying a shear force to a solution in which an aqueous solvent and a liquid mixture including the binder resin and the colorant as necessary (polymer liquid). At this time, emulsified particles may be formed by heating the polymer liquid to a temperature that is the glass transition temperature or higher of the binder resin so as to lower the viscosity of the polymer liquid. In addition, it is also possible to use a dispersing agent. Hereinafter, there is a case in which a dispersion liquid of such emulsified particles is referred to as the "binder resin dispersion liquid."

Examples of the emulsification equipment used to form the emulsified particles include a homogenizer, a homomixer, a pressurization kneader, an extruder, a media dispersing device, and the like. The size of the emulsified particles (liquid droplet) in the binder resin is preferably from 0.010 μm to 0.5 μm, and more preferably from 0.05 μm to 0.3 μm in terms of the average particle diameter (volume average particle diameter). Meanwhile, the volume average particle diameter of the resin particles is measured using a Doppler scattering-type particle size distribution measurement device (manufactured by Nikkiso Co., Ltd., MICROTRACK UPA9340).

In addition, when the melting viscosity of the resin is large during emulsification, the particle diameter does not decrease to a desired value, and therefore a binder resin dispersion liquid having a desired particle diameter may be obtained by increasing the temperature using an emulsification apparatus that may pressurize to the atmospheric pressure or higher so as to emulsify particles in a state in which the resin viscosity decreases.

In the emulsification process, a solvent may be added to the resin in advance for the purpose of decreasing the viscosity of the resin. The solvent being used is not particularly limited as long as the solvent may dissolve the binder resin, and an ether solvent, such as tetrahydrofuran (THF), an ester or ketone solvent, such as methyl acetate, ethyl acetate, or methyl ethyl ketone, a aromatic solvent, such as benzene, toluene, or xylene, or the like may be used, and an ester or ketone solvent, such as ethyl acetate, or methyl ethyl ketone, is preferably used.

In addition, an alcohol solvent, such as ethanol or isopropyl alcohol, may be directly added to water or the resin. In addition, a salt, such as sodium chloride or calcium chloride, ammonia, or the like may be added. Among the above, ammonia is preferably used.

Furthermore, a dispersion agent may also be added. Examples of the dispersion agent include surfactants, such as aqueous polymers, such as polyvinyl alcohol, methyl cellulose, carboxymethyl cellulose, and sodium polyacrylate;

anionic surfactants, such as sodium dodecylbenzene sulfonate, sodium octadecyl sulfate, sodium oleate, sodium laurate, and potassium stearate; cationic surfactants, such as laurylamine acetate and lauryl trimethyl ammonium chloride; amphoteric surfactants, such as lauryl dimethylamine oxide; and nonionic surfactants, such as polyoxyethylene alkyl ether, polyoxyethylene alkyl phenyl ether, or polyoxyethylene alkylamine. Among the above, an anionic surfactant is preferably used.

The amount of the dispersion agent being used is preferably from 0.01 part by weight to 20 parts by weight with respect to 100 parts by weight of the binder resin. However, since there is a case in which the dispersion agent influences charging properties, the amount of the dispersion agent being added is preferably as little as possible when emulsifying properties may be secured through the hydrophilic properties of the main chain of the binder resin, the acid value of the end, the amount of hydroxyl value, and the like.

Meanwhile, in the emulsification process, in a case in which a polyester resin is used as the binder resin, a dicarboxylic acid having a sulfonic acid group may be copolymerized (that is, a preferable amount of a dicarboxylic acid-derived component unit having a sulfonic acid group is included in an acid-derived component unit). The added amount is preferably 10 mol % or less in the acid-derived component unit, but the amount of the dicarboxylic acid-derived component unit being added is preferably as little as possible when emulsifying properties may be secured through the hydrophilic properties of the main chain of the binder resin, the acid value of the end, the amount of hydroxyl value, and the like.

In addition, a phase-transfer emulsification method may be used to form the emulsified particles. In the phase-transfer emulsification method, the binder resin is dissolved in the solvent, a neutralizing agent or a dispersion stabilizing agent is added as necessary, and an aqueous medium is added dropwise under stirring, thereby obtaining emulsified particles, then, the solvent in the resin dispersion liquid is removed so as to obtain an emulsified liquid. At this time, the order of adding the neutralizing agent or the dispersion stabilizing agent may be changed.

Examples of the solvent that dissolves the resin include formic acid ester, acetic acid ester, butyric acid ester, ketones, ethers, benzenes, and halogenated carbons. Specifically, esters, such as methyl, ethyl, n-propyl, isopropyl, n-butyl, isobutyl, sec-butyl, and t-butyl ester of formic acid, acetic acid, and butyric acid; methyl ketones, such as acetone, methyl ethyl ketone (MEK), methyl propyl ketone (MPK), methyl isopropyl ketone (MIPK), methyl butyl ketone (MBK), and methyl isobutyl ketone (MIRK); ethers, such as diethyl ether and diisopropyl ether; heterocyclic substitute, such as toluene, xylene, and benzene; halogenated carbons, such as carbon tetrachloride, methylene chloride, 1,2-dichloroethane 1,1,2-trichloroethene, trichloroethylene, chloroform, monochlorobenzene, and dichloroethylidene; or the like may be used singly or in combination of two or more kinds thereof. Among the above, generally, acetic esters, methyl ketones, and ethers of a low-boiling point solvent are preferably used, and acetone, methyl ethyl ketone, acetic acid, ethyl acetate, and butyl acetate are particularly preferable. The solvent to be used preferably has relative high volatile properties so that the solvent does not remain in the resin particles. The amount of the solvent being used is preferably from 20% by weight to 200% by weight, and more preferably from 30% by weight to 100% by weight with respect to the amount of the resin.

As the aqueous medium, basically, ion exchange water is used, but an aqueous solvent may be included as long as oil droplets are not destroyed. The aqueous solvent that is preferably used includes short-carbon chain alcohols, such as methanol, ethanol, 1-propanol, 2-propanol, 1-butanol, 2-butanol, t-butanol, and 1-pentanol; ethylene glycol monoalkyl ethers, such as ethylene glycol monomethyl ether, ethylene glycol monoethylether, ethylene glycol monbutyl ether; ethers, diols, THF, acetone, and the like, and ethanol and 2-propanol are preferably used.

The amount of the aqueous solvent being used is preferably from 0% by weight to 100% by weight, and more preferably from 5% by weight to 60% by weight with respect to the amount of the resin. In addition, the aqueous solvent may not only be mixed with ion exchange water being added, but also be added to the resin-dissolved liquid.

In addition, the dispersion agent may be added to a binder resin solution and an aqueous component as necessary. The dispersion agent includes dispersion agents that form hydrophilic colloids in the aqueous component, and, particularly includes cellulose derivatives, such as hydroxymethyl cellulose, hydroxyethyl cellulose, and hydroxypropyl cellulose; synthesized polymers of polyvinyl alcohol, polyvinyl pyrrolidone, polyacrylamide, polyacrylate, and polymethacrylate, dispersion stabilizing agents, such as gelatin, gum arabic, and agar.

Generally, the dispersion stabilizing agent is added so that the concentration in the aqueous component becomes preferably from 0% by weight to 20% by weight, and more preferably from 0% by weight to 10% by weight.

A surfactant may be also used as the dispersion agent. Examples of the surfactant that may be used include the same substances as used for the colorant dispersion liquid described below.

A neutralizing agent may be added in order to adjust the pH of the emulsified liquid. The neutralizing agent that may be used include ordinary acids and alkalis, such as nitric acid, hydrochloric acid, sodium hydroxide, and ammonia.

As a method of removing the solvent from the emulsified liquid, a method in which the solvent is volatilized from the emulsified liquid at from 15° C. to 70° C. and a method in which depressurization is combined into the above method are preferably used.

In the exemplary embodiment, a method in which the particles are emulsified by the phase-transfer emulsification method, and then depressurized while being heated so as to remove the solvent is preferably used from the viewpoint of the particle size distribution or the particle size controllability. In addition, in a case of being used for the toner, the emulsifying properties are controlled through the hydrophilic properties of the main chain of the binder resin, the acid value of the end, the amount of hydroxyl value, and the like using a dispersion agent or a surfactant as little as possible, which is preferable from the viewpoint of influence on the charging properties.

Examples of a method of dispersing the colorant or the release agent that may be used include ordinary dispersion methods in which a high-pressure homogenizer, a rotary shearing homogenizer, an ultrasonic dispersing device, a high-pressure impact dispersing device, a ball mill having media, a sand mill, a die mill, or the like is used, and is not limited.

It is also possible to use a surfactant so as to prepare an aqueous dispersion liquid of a colorant or to use a dispersion agent so as to prepare an organic solvent dispersion liquid of a colorant. Hereinafter, such dispersion liquids of the colorant and the release agent will be sometimes termed the "colorant dispersion liquid" and the "release agent dispersion liquid."

The dispersion agent used for the colorant dispersion liquid or the release agent dispersion liquid is generally a surfactant. Preferable examples of the surfactant include sulfuric acid ester salt, sulfonic acid salt, phosphoric acid ester, and soap anionic surfactants; amine salt, and quaternary ammonium salt cationic surfactants; polyethylene glycol, alkyl phenol ethylene oxide adduct and polyol nonionic surfactant; and the like. Among the above, the ionic surfactants are preferable, and the anionic surfactant and the cationic surfactant are more preferable. The nonionic surfactant may be used in combination with the anionic surfactant or the cationic surfactant. In addition, the dispersion agent preferably has the same polarity as the dispersion agents used for other dispersion liquid, such as the release agent dispersion agent.

Specific examples of the anionic surfactant include fatty acid soaps, such as potassium laurate and sodium oleate; sulfuric acid esters, such as octyl sulfate and lauryl sulfate; sulfonic acid salts, such as sodium alkyl naphthalene sulfate of lauryl sulfonate, dodecyl sulfonate, dodexyl benzene sulfonate, naphthalene sulfonate formalin condensate, monooctyl sulfosuccinate, dioctyl sulfosuccinate; phosphoric acid esters, such as lauryl phosphate and isopropyl phosphate; sulfosuccinic acid salts, such as dialkyl sodium sulfosuccinate, such as dioctyl sodium sulfosuccinate, disodium lauryl sulfosuccinate, and disodium lauryl polyoxyethylene sulfosuccinate; and the like. Among the above, alkylbenzene sulfonate compounds, such as dodexyl benzene sulfonate and branched form thereof, are preferable.

Specific examples of the cationic surfactant include amine salts, such as hydrochloride salt of laurylamine and hydrochloride salt of stearylamine; quaternary ammonium salts, such as lauryltrimethylammonium chloride and dilauryldimethylammonium chloride; and the like.

Specific examples of the nonionic surfactant include alkyl ethers, such as polyoxyethylene octyl ether and polyoxyethylene lauryl ether; alkylphenyl ethers, such as polyoxyethylene octylphenyl ether and polyoxyethylene nonylphenyl ether; alkyl esters, such as polyoxyethylene laurate, polyoxyethylene stearate, and polyoxyethylene oleate; alkyl amines, such as polyoxyethylene laurylamino ether, polyoxyethylene stearylamino ether, and polyoxyethylene oleylamino ether; alkylamides such as polyoxyethyelene lauric acid amide and polyoxyethylene stearic acid amide; vegetable oil ethers, such as polyoxyethylene castor oil ether and polyoxyethylene rapeseed oil ether; alkanol amides, such as lauric acid diethanol amide, stearic acid diethanol amide, and oleic acid diethanol amide; and sorbtan ester ethers, such as polyoxyethylene sorbitan monolaurate, and polyoxyethylene sorbitan monopalmitate; and the like.

The added amount of the dispersion agent being used is preferably from 2% by weight to 30% by weight, and more preferably from 5% by weight to 10% by weight with respect to the colorant or the release agent.

The aqueous dispersion medium being used preferably contains few impurities including metal ions, such as distilled water, ion exchange water, and the like, and, furthermore, an alcohol or the like may be added. In addition, it is also possible to add polyvinyl alcohol, a cellulose polymer, or the like, but the above additives are preferably used as little as possible so that the additives do not remain in the toner.

In addition, a measure of manufacturing a dispersion liquid of inorganic particles or a variety of the additives is not particularly limited, and examples thereof include well-known dispersion apparatuses, such as a rotary shearing homogenizer, a ball mill having media, a sand mill, a Dinomill, additionally, apparatuses equivalent to an apparatus used to manufacture the colorant dispersion liquid or the release agent dispersion liquid, and the most appropriate measure may be selected and used.

In the aggregation process, the dispersion liquid of the binder resin particles, the colorant dispersion liquid, the release agent dispersion liquid, and the like are mixed so as to prepare a liquid mixture, the liquid mixture is heated to a temperature that is the glass transition temperature or lower of the binder resin particles so as to agglomerate particles, thereby forming aggregated particles. The aggregated particles are frequently formed by adjusting the pH of the liquid mixture to be acidic under stirring. The pH is preferably in a range of from 2 to 7, and, at this time, use of an aggregating agent is also effective.

Meanwhile, in the aggregation process, the release agent dispersion liquid may be added to and mixed with a variety of the dispersion liquids, such as the binder resin particle dispersion liquid, at one time, or added over plural divided times.

In the aggregation process, use of an aggregating agent is preferable in order to form aggregated particles. The aggregating agent being used includes surfactants which have a polarity opposite to that of the surfactants used for the dispersion agent, ordinary inorganic metal compounds (inorganic metal salts), and polymers thereof. Metal elements that compose the inorganic metal salts are metals having di- or more valent charges which belong to Groups 2A, 3A, 4A, 5A, 6A, 7A, 8, 1B, 2B, and 3B in the periodic table (long periodic table), and may be metals that dissolve in an ion form in the aggregation system of the resin particles.

The inorganic metal salt that may be used specifically include metal salts, such as barium chloride, magnesium chloride, zinc chloride, aluminum chloride, and aluminum sulfate; inorganic metal salt polymers, such as polyaluminum chloride and polyaluminum hydroxide; and the like. Among the above, aluminum salt and polymer thereof are particularly preferable. Generally, in order to obtain a sharper particle size distribution, the valence of the inorganic metal salt is preferably divalent rather than monovalent, and trivalent rather than divalent, and, even when the valence are the same, a inorganic metal salt polymer is more preferable.

The added amount of the aggregating agent varies by the kind or valence of the aggregating agent; however, approximately, is preferably in a range of from 0.05% by weight to 0.1% by weight. The aggregating agent does not always remain in the toner at the total added amount during the toner preparing process due to ejection into the aqueous medium, formation of coarse powder, or the like. Particularly, in a case in which the amount of the solvent in the resin is large, since the solvent and the aggregating agent act with each other during the toner preparing process such that the aggregating agent is easily ejected into the aqueous medium, the added amount of the aggregating agent is preferably adjusted depending on the amount of the residual solvent.

In the coalescence process, it is preferable to stop the progress of aggregation by adjusting the pH of the suspension liquid of an aggregated substance in a range of from 5 to 10 under stirring equivalent to stirring in the aggregation process, and coalescing aggregated particles by carrying out heating at a temperature that is the glass transition temperature (Tg) or higher of the resin. In addition, the heating needs to be carried out so as to prepare a preferable coalescence, and is preferably carried out for from 0.2 hour to 10 hours. After that, the temperature is decreased to the Tg or lower of the resin, and the particle shape and the surface properties vary by the temperature-decrease rate when the particles are solidified. The temperature is decreased to the Tg or lower of the resin preferably at a rate of 0.5° C./min or more and more preferably at a rate of 1.0° C./min or more.

In addition, if the particles are grown by carrying out heating at a temperature that is the Tg or higher of the resin and adjusting the pH or adding an aggregating agent, similarly to the aggregation process, and the temperature is decreased to the Tg or lower of the resin at a rate of 0.5° C./rain, similarly to the case of the coalescence process, when a desired particle diameter reaches, thereby stopping the particle growth at the same time as solidification, since the aggregation process and the coalescence process are carried out at the same time, it is preferable in terms of simplification of the processes, but there is a case in which it becomes difficult to prepare the above core shell structure.

After completion of the coalescence process, the particles are washed and dried so as to obtain toner particles. Meanwhile, it is preferable to carry out displacement washing on the particles using ion exchange water, and the washing degree is generally monitored using the electrical conductivity of a filtrate, and it is preferable to adjust the electrical conductivity, ultimately, to 25 μS/cm or lower. During the washing, a process in which ions are neutralized using an acid or an alkali may be included, and a treatment using an acid is preferably adjusted to 6.0 or lower in terms of pH, and a treatment using an alkali is preferably adjusted to 8.0 or more in terms of pH.

In addition, solid and liquid separation after the washing is not particularly limited, but pressure filtration, such as suction filtration or filter-press, is preferably used from the viewpoint of productivity. Furthermore, drying is also not particularly limited in methods, but freezing drying, flash jet drying, fluidization drying, vibration fluidization drying, and the like are preferably used from the viewpoint of productivity, and the drying is carried out so that the final moisture rate of the toner becomes 1% by weight or less and more preferably 0.7% by weight or less.

In the exemplary embodiment, a method of forming a salt between the carboxylic group included in the binder resin present on the surfaces of the toner particles and the alkaline earth metal is not particularly limited.

Examples of the method include a method in which, when the toner particles are manufactured by the emulsion aggregation method, a strong alkali component, such as sodium hydroxide or potassium hydroxide, is added to a dispersion liquid including aggregated particles or toner particles that are yet to be subjected to a coalescence treatment in the coalescence process, the mixture is heated so as to turn the carboxylic group included in the binder resin present on the surfaces of the toner particles and the like into an alkali metal salt, and an alkaline earth metal compound, such as a halide or hydroxide of an alkaline earth metal, is added, thereby turning the alkali metal salt of the carboxylic group into an alkaline earth metal salt of the carboxylic group. A reaction in which the alkali metal is substituted into an alkaline earth metal progresses, generally, under a condition of room temperature (20° C.).

It is considered that the carboxylic group included in the binder resin easily moves to the interfaces between the resin particles and the aqueous medium in the emulsification phase, and thus emulsified particles have a structure in which more carboxylic groups are present on the surfaces, and, consequently, according to the method in which the alkali metal salt of the carboxylic group is made into the alkaline earth metal salt of the carboxylic group, the carboxylic group included in the binder resin present on the surfaces of the toner particles and the like efficiently turns into the alkaline earth metal salt.

In the exemplary embodiment, in a case in which the toner particles are manufactured by undergoing the emulsion aggregation method, the toner particles may be manufactured by undergoing an aggregation process in which aggregated particles are formed in a dispersion liquid in which binder resin particles are dispersed so as to prepare an aggregated particle dispersion liquid, a coalescence process in which a strong alkali component is added to the aggregated particle dispersion liquid, and the mixture is heated so as to coalesce the aggregated particles, thereby obtaining coalesced particles (toner particles), and an alkaline earth metal salt forming process in which an alkaline earth metal compound is added to a dispersion liquid including the coalesced particles so as to form a salt of the carboxylic group included in the binder resin present on the surfaces of the coalesced particles and the alkaline earth metal.

On the other hand, in a case in which the toner particles are manufactured by a dry method, such as the kneading and pulverizing method, a treatment method of the toner particles that undergoes a dispersion liquid preparing process in which a dispersion liquid of the toner particles is prepared, a heating process in which a strong alkali component is added to the dispersion liquid, and the mixture is heated, and an alkaline earth metal salt forming process in which an alkaline earth metal compound is added to the dispersion liquid that has undergone the heating process so as to form a salt of the carboxylic group included in the binder resin present on the surfaces of the toner particles and the alkaline earth metal may be carried out.

When the dispersion liquid of the toner particles is prepared, the above surfactant may be used.

The unreacted portions of the alkaline earth metal compound are removed from the surfaces of the toner particles by carrying out the washing treatment on the toner particles obtained by undergoing the above processes (toner particles in which the carboxylic group included in the binder resin present on the surface and the alkaline earth metal form a salt). The amount of the alkaline earth metal which is detected through ion chromatography may be adjusted to from $1.00\times10^{-10}$ mol/g to $0.90\times10^{-6}$ mol/g by undergoing the above processes.

In the exemplary embodiment, the alkaline earth metal that forms a salt with the carboxylic group included in the binder resin present on the surfaces of the toner particles includes calcium, strontium, and barium. Among the above, calcium is preferable from the viewpoint of stable reactivity.

The alkaline earth metal compound used in the above reaction is preferably soluble in water, and examples thereof include chlorides, hydroxides, and the like of the alkaline earth metal.

Examples of the calcium compound used in the above reaction include calcium chloride, calcium hydroxide, calcium carbonate, calcium hydrocarbon, and the like, and, among the above, calcium chloride is preferable in terms of the high solubility in water.

The added amount of the alkaline earth metal compound is preferably from 0.01 part by weight to 10 parts by weight, and more preferably from 0.05 part by weight to 1.0 part by weight with respect to 100 parts by weight of the toner particles or the aggregated particles.

External Additive

In the toner according to the exemplary embodiment, inorganic particles and/or organic particles may be externally added to the toner particles obtained in the above manner as external additives, such as a fluidity aid, a cleaning aid, and a polishing aid.

Here, the external additive that is used has an average particle diameter of from 10 nm to 30 nm, and preferably from 15 nm to 30 nm.

When the external additive has an average particle diameter of from 10 nm to 30 nm, appropriate fluidity is obtained, the toner is not supplied to a developing machine in excess, the supply amount is stable, and no density unevenness occurs.

Meanwhile, the average primary particle diameter of the external additive is measured as follows.

The toner having an external additive is dispersed in water using a small amount of a surfactant, and then dispersed using ultrasonic waves. After the toner is removed through filtration, the external additive present on the filtrate side is measured using an LS COULTER (manufactured by Beckman Coulter), and the obtained number average particle diameter is used as the average particle diameter of the external additive.

Examples of the inorganic particles used as the external additive include all inorganic particles used as an ordinary external additive for the surfaces of the toner particles, such as silica, alumina, titanium oxide, magnesium carbonate, and cerium oxide. The inorganic particles are preferably hydrophobized on the surfaces.

Examples of the organic particles used as the external additive include all organic particles used as an ordinary external additive for the surfaces of the toner, such as vinyl resin, such as styrene polymers, (meth)acryl polymers, and ethylene polymers, polyester resins, silicone resins, and fluororesins.

In addition, a mixture of two or more kinds of the inorganic particles having different particle diameters may be used, and one of them preferably has an average primary particle diameter of from 30 nm to 200 nm, and more preferably has an average primary particle diameter of from 30 nm to 180 nm.

Specifically, the external additive is preferably silica, alumina, or titanium oxide, and addition of hydrophobized silica is particularly preferable. Particularly, joint use of silica and titanium oxide or joint use of silica having different particle diameters is preferable. In addition, joint use of organic particles having a particle diameter of from 80 nm to 500 nm is also preferable.

A hydrophobizing agent that hydrophobizes the external additive include well-known materials, which include coupling agents, such as silane coupling agent, titanate coupling agent, aluminate coupling agent and zirconium coupling agent, silicone oil, and the like. In addition, the hydrophobilizing treatment of the external additive includes a polymer coating treatment and the like.

The above external additive is preferably attached or fixed to the surfaces of the toner particles by providing a mechanical impulsive force using a V-shape blender, a sample mill, a Henschel mixer, or the like.

Furthermore, a lubricant may also be added in addition to the external additive.

Examples of the lubricant include fatty acid amides, such as ethylene bis stearamide and oleamide; fatty acid metal salts, such as zinc stearate; higher alcohols, such as unirine; and the like.

Properties of the Toner

The toner of the exemplary embodiment preferably has a volume average particle diameter (that is, the particle diameter of the toner particles, this definition applies throughout the present paragraph) in a range of from 1 μm to 9 μm. When the volume average particle diameter is 9 μm or less, it is easy to reproduce a high-definition image. In addition, when the volume average particle diameter is 1 μm or more, occurrence of reverse-polar toner is suppressed, and the influence on images, such as background fogging or white spot, is reduced.

Meanwhile, in the toner of the exemplary embodiment, since the amount of the alkaline earth metal, which is detected through ion chromatography, is made to be in the above specific range, unreacted portions of the alkaline earth metal salt do not remain on the surface of the toner in excess, and deterioration of the charging level of the toner is suppressed. Generally, when the volume average particle diameter of the toner is in a range of from 1 μm to 5 μm, the amount of charges per toner particle decreases, and fogging is liable to occur. In the toner of the exemplary embodiment, since degradation of the charging level of the toner is suppressed, fogging does not easily occur even in a case in which the toner is a so-called small particle diameter toner having a volume average particle diameter of from 1 μm to 5 μm, which is particularly effective.

In addition, for the toner of the exemplary embodiment, in the particle size distribution measured by the following method, cumulative distribution is drawn from the small diameter side for each of the volume and number in the divided particle size range (channel), a particle diameter at which the cumulative volume becomes 16% is defined to be a volume $D_{16V}$, a particle diameter at which the cumulative volume becomes 50% is defined to be a volume $D_{50V}$, and a particle diameter at which the cumulative volume becomes 84% is defined to be a volume $D_{84V}$, the volume average particle size distribution index ($GSD_V$) calculated from $(D_{84V}/D_{16V})^{0.5}$ is preferably from 1.15 to 1.30, and more preferably from 1.15 to 1.25.

The volume average particle diameter and the like are measured using a MULTISIZER II (manufactured by Beckman Coulter) and an aperture diameter of 50 μm or 100 μm.

In addition, for the particle size distribution, cumulative distribution is drawn from the small particle diameter side for each of the volume and number in the particle size range divided based on the particle size distribution measured using the MULTISIZER II (number of division: a range of from 1.59 μm to 64.0 μm is divided into 16 channels at intervals of 0.1 in the log scale. Specifically, the distribution is divided so that the channel 1 is set to from 1.59 μm to less than 2.00 μm, the channel 2 is set to from 2.00 μm to less than 2.52 μm, the channel 3 is set to from 2.52 μm to less than 3.175 μm, . . . , and the log values of the lower limit values on the left side become 0.2 (=log 1.59), 0.3 (=log 2.0), 0.4 (=log 2.52), . . . , 1.7), a particle diameter at which the cumulative becomes 16% is defined to be a volume $D_{16V}$ and a number $D_{16P}$, a particle diameter at which the cumulative becomes 50% is defined to be a volume $D_{50V}$ (volume average particle diameter) and a number $D_{50P}$, and a particle diameter at which the cumulative becomes 84% is defined to be a volume $D_{84V}$ and a number $D_{84P}$.

In addition, the toner preferably has a spherical shape having a shape factor SF1 in a range of from 110 to 145. When the shape is spherical in the above range, transfer efficiency and the compactness of images improve, and a high-quality image may be formed.

The shape factor SF1 is more preferably in a range of from 110 to 140.

Here, the shape factor SF1 is obtained from the following formula (1).

$$SF1=(ML^2/A)\times(\pi/4)\times100 \quad \text{Formula (1)}$$

In the formula (1), ML represents the absolute maximum length of the toner particles, and A represents the projected area of the toner particles.

The shape factor SF1 may be calculated, for example, in the following manner after a microscopic image or a scanning electron microscopic (SEM) image is analyzed so as to be digitalized using an image analysis apparatus. That is, an optical microscopic image of the toner particles scattered on the surface of a glass slide is scanned to a RUZEX image analysis apparatus through a video camera, the maximum lengths and projected areas of 100 or more toner particles are obtained, the shape factors are calculated through the formula (I), and an average value is obtained.

When the shape factor SF1 of the toner is in the above range, excellent charging properties, cleaning properties, and transfer properties may be obtained for a long time.

In recent years, there are frequent cases in which the degree of circularity is measured using an FPIA-3000 manufactured by Sysmex Corporation since the degree of circularity may be easily measured. The FPIA-3000 optically measures approximately 4,000 particle images, and image-analyzes the projected image of each of the particles. Specifically, firstly, a boundary length (the boundary length of a particle image) is calculated from the projected image of one particle. Next, the area of the projected image is calculated, a circle having the same area as the above area is imagined, and the degree of circularity of the circle is calculated (the circumferential length of the circle obtained from the equivalent circle diameter). The degree of circularity is calculated using a formula of the degree of circularity=the circumferential length of the circle obtained from the equivalent circle diameter/the boundary length of the particle image, and the particle becomes more circular as the numeric value approximates to 1.0. The degree of circularity is preferably from 0.945 to 0.990, and more preferably from 0.950 to 0.975. When the degree of circularity is 0.950 or more, favorable transfer efficiency may be obtained. In addition, when the degree of circularity is 0.975 or less, favorable cleaning properties may be obtained.

Meanwhile, there is a deviation between apparatuses, a shape factor SF1 of 110 is equivalent to, approximately, a degree of circularity of 0.990 in the FPIA-3000. In addition, a shape factor SF1 of 140 is equivalent to, approximately, a degree of circularity of 0.945 in the FPIA-3000.

Furthermore, in the toner according to the exemplary embodiment, the total energy amount from the filling surface of the toner to a depth of 70 mm at a front end speed of the rotary blade, which is measured using a powder rheometer, of 100 mm/s and an entrance angle of the rotary blade of −5° is preferably from 250 mJ to 700 mJ, and more preferably from 450 mJ to 700 mJ.

It is found that, as described above, with the configuration of the toner according to the exemplary embodiment, the above total energy amount may be achieved, and the fluidity of the toner is excellent with the above value of the total energy amount.

Meanwhile, the total energy amount is measured using a powder rheometer, specifically, in the following manner. A FT4 manufactured by Freeman Technology is used as the powder rheometer.

Firstly, a toner to be measured is filled in a vessel. A 160 mL vessel having an inner diameter of 50 mm and a height of 88 mm is used. A carrier is filled up to 88 mm in the vessel. Before measurement, the toner is left to stand idle for 8 or more hours in a state of a temperature of 22° C. and a humidity of 50% RH so as to prevent occurrence of an error due to the external environment during measurement.

After the filling, conditioning of the toner is carried out before measurement of the fluidity in order to remove unevenness in the measured values due to changes in the filing conditions. During the conditioning, the rotary blade is smoothly stirred in a rotary direction in which the rotary blade does not receive any resistance from the toner (the opposite direction to the rotary direction during measurement) so as to prevent supply of excessive stress to the toner in a filled state so as to remove excessive air or almost all partial stress, and a sample is made to be in a homogeneous state.

After completion of the conditioning, the rotary blade is rotated while being moved into the toner.

The rotary torque and the vertical load are measured when the rotary blade rotates the particles filled in the vessel at the front end speed of the rotary blade of 100 mm/s while being moved at an entrance angle of −5°.

Meanwhile, the entrance angle refers to an angle formed between the axis of the measurement vessel and the rotary axis of the rotary blade.

An average value of the total energy amounts (mJ) when the above operation is repeated 5 times is defined to be the total energy amount (mJ) in the exemplary embodiment.

Electrostatic Charge Image Developer

The electrostatic charge image developer of the exemplary embodiment includes the toner of the exemplary embodiment.

The toner of the exemplary embodiment may be used as a single-component developer or a two-component developer. In a case in which the toner is used as a two-component developer, the toner is mixed with a carrier, and then used.

The carrier that may be used for the two-component developer is not particularly limited, and well-known carriers are used. Examples thereof include magnetic metals, such as iron oxide, nickel, and cobalt; magnetic oxides, such as ferrite and magnetite, resin-coated carriers having a resin coating layer on the surface of the core material, magnetic dispersion-type carriers, and the like. In addition, the carrier may be a resin dispersion-type carrier in which a conductive material and the like are dispersed in a matrix resin.

Examples of the coating resin and matrix resin used for the carrier include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymer, styrene-acrylate copolymer, straight silicone resin including an organosiloxane bond and modified products thereof, fluororesin, polyester, polycarbonate, phenol resins, epoxy resins, and the like, but the resin-coated and matrix resin are not limited thereto.

Examples of the conducting material include metals, such as gold, silver, and copper, carbon black, furthermore, titanium oxide, zinc oxide, barium oxide, aluminum borate, potassium titanate, tin oxide, carbon black, and the like, but the conducting material is not limited thereto.

In addition, the core material of the carrier includes magnetic metals, such as iron, nickel, and cobalt; magnetic oxides, such as ferrite and magnetite; glass beads, and the like, but is preferably a magnetic material in order to use the carrier in the magnetic brush method. The volume average particle diameter of the core material of the carrier is generally in a range of from 10 μm to 500 μm, and more preferably in a range of from 30 μm to 100 μm.

In addition, the method for coating the surface of the core material of the carrier with a resin includes a method in which the coating with the resin is carried out using a coating layer-forming solution in which the coating resin and a variety of additives as necessary are dissolved in an appropriate solvent, and the like. The solvent is not particularly limited, and the coating resin being used may be selected in consideration of coating aptitude, and the like.

The specific resin coating method includes a dipping method in which the core material of the carrier is dipped in the coating layer-forming solution, a spray method in which the coating layer-forming solution is sprayed to the surface of the core material of the carrier, a fluidized bed method in which the coating layer-forming solution is sprayed in a state in which the core material of the carrier is floated using fluidized air, a kneader coater method in which the core material of the carrier and the coating layer-forming solution are mixed in a kneader coater, and the solvent is removed, and the like.

The mixing ratio (weight ratio) between the electrostatic charge image developing toner of the exemplary embodiment and the carrier in the two-component developer is in a range of approximately 1:100 to 30:100 in terms of toner:carrier, and more preferably in a range of 3:100 to 20:100.

Image Forming Apparatus and Image Forming Method

Next, the image forming apparatus of the exemplary embodiment in which the electrostatic charge image developing toner of the exemplary embodiment is used will be described.

The image forming apparatus of the exemplary embodiment has a photoreceptor, a charging unit that charges the photoreceptor, an electrostatic charge image forming unit that forms an electrostatic charge image on the surface of the charged photoreceptor, a developing unit that develops the electrostatic charge image formed on the surface of the photoreceptor as a toner image using the electrostatic charge image developer of the exemplary embodiment, a transfer unit that transfers the toner image to a recording medium, and a fixing unit that fixes the toner image.

According to the image forming apparatus of the exemplary embodiment, the image forming method of the exemplary embodiment including charging a photoreceptor, forming an electrostatic charge image on the surface of the charged photoreceptor, developing the electrostatic charge image formed on the surface of the photoreceptor as a toner image using the electrostatic charge image developer of the exemplary embodiment, transferring the toner image to a recording medium, and fixing the toner image is carried out.

Meanwhile, in the image forming apparatus, for example, the portion including the developing unit may have a cartridge structure that is detachable from the main body of the image forming apparatus (process cartridge), and the process cartridge of the exemplary embodiment which has at least a developer holding member and accommodates the electrostatic charge image developer of the exemplary embodiment is preferably used as the process cartridge.

Hereinafter, an example of the image forming apparatus of the exemplary embodiment will be shown, but the image forming apparatus is not limited thereto. Meanwhile, main portions shown in the drawing will be described, and other portions will not be described.

FIG. 1 is a schematic configuration view showing a 4 tandem color image forming apparatus. The image forming apparatus shown in FIG. 1 has first to fourth electrophotographic image forming units 10Y, 10M, 10C and 10K (image forming units) that output images of the respective colors of yellow (Y), magenta (M), cyan (C), and black (K) based on color-decomposed image data. The image forming units (hereinafter sometimes referred to simply as the "units") 10Y, 10M, 10C, and 10K are provided in parallel at predetermined mutual distance intervals in the horizontal direction. Meanwhile, the units 10Y, 10M, 10C, and 10K may be a process cartridge that is detachable from the main body of the image forming apparatus.

An intermediate transfer belt 20 is provided as an intermediate transfer member through the respective units above the respective units 10Y, 10M, 10C, and 10K in the drawing. The intermediate transfer belt 20 is supported by a driving roller 22 and a support roller 24 that is in contact with the inside surface of the intermediate transfer belt 20, which are mutually separately disposed from the left to right direction in the drawing, and is configured to run in a direction from the first unit 10Y to the fourth unit 10K. Further, the support roller 24 is applied with a force in a direction separating from the driving roller 22 using a spring, not shown, or the like so that a tension is applied to the intermediate transfer belt 20 supported by the driving roller 22 and the support roller 24. In addition, an intermediate transfer member cleaning apparatus 30 is provided opposite to the driving roller 22 on the side surface of an image holding member of the intermediate transfer belt 20.

In addition, toners of four colors of yellow, magenta, cyan, and black, which are accommodated in the toner cartridges 8Y, 8M, 8C, and 8K, are supplied to developing apparatuses (developing units) 4Y, 4M, 4C, and 4K of the respective units 10Y, 10M, 10C, and 10K.

Since the first to fourth units 10Y, 10M, 10C, and 10K have the same configuration, here, the first unit 10Y that forms a yellow image, which is provided on the upstream side of the intermediate belt running direction, will be described as a representative. Further, the second to fourth units 10M, 10C, and 10K will not be described by attaching reference signs including magenta (m), cyan (C), and black (K) instead of yellow (Y) to the same portions as in the first unit 10Y.

The first unit 10Y has a photoreceptor 1Y as an image holding member. Around the photoreceptor 1Y, a charging roller 2Y that charges the surface of the photoreceptor 1Y to a predetermined potential, an exposure apparatus (electrostatic charge image forming unit) 3 that exposes the charged surface using a laser light ray 3Y based on a color-decomposed image signal so as to form an electrostatic charge image, a developing apparatus (developing unit) 4Y that supplies the charged toner to the electrostatic charge image so as to develop the electrostatic charge image, a primary transfer roller 5Y (primary transfer unit) that transfers the developed toner image to the intermediate transfer belt 20, and a photoreceptor cleaning apparatus (cleaning unit) 6Y that removes the toner remaining on the surface of the photoreceptor 1Y after primary transfer are sequentially disposed.

Further, the primary transfer roller 5Y is disposed inside the intermediate transfer belt 20, and provided at a position facing the photoreceptor 1Y. Furthermore, bias power supplies (not shown) that apply a primary transfer bias are connected respectively to the primary transfer rollers 5Y, 5M, 5C, and 5K. The respective bias power supplies vary the transfer bias applied to the respective primary transfer rollers through control by a control portion, not shown.

Hereinafter, an operation of forming a yellow image in the first unit 10Y will be described. Firstly, before the operation, the surface of the photoreceptor 1Y is charged to a potential of approximately −600 V to −800 V using the charging roller 2Y.

The photoreceptor 1Y is formed by laminating a photosensitive layer on a conductive (volume resistivity at 20° C.: $1\times10^{-6}$ Ωcm or less) base material. The photosensitive layer is generally highly resistant (approximately the resistance of an ordinary resin); however, when the laser light ray 3Y is irradiated, the specific resistance in portions to which the laser light ray is irradiated changes. Therefore, the laser light ray 3Y is outputted to the surface of the charged photoreceptor 1Y through the exposure apparatus 3 according to yellow image data sent from the control portion, not shown. The laser light ray 3Y is irradiated to the photosensitive layer on the surface of the photoreceptor 1Y so that an electrostatic charge image of a yellow printing pattern is formed on the surface of the photoreceptor 1Y.

The electrostatic charge image refers to an image formed on the surface of the photoreceptor 1Y through charging, and a so-called negative latent image formed by the fact that the specific resistance in the irradiated portions of the photosensitive layer lowers due to the laser light ray 3Y, the charged charges on the surface of the photoreceptor 1Y flow, and, on the other hand, charges in portions to which the laser light ray 3Y is not irradiated remain.

The electrostatic charge image formed on the photoreceptor 1Y in the above manner is rotated up to a predetermined developing position along running of the photoreceptor 1Y. In addition, the electrostatic charge image on the photoreceptor 1Y is made into a visual image (developed image) using the developing apparatus 4Y at the developing position.

The developing apparatus 4Y accommodates, for example, the electrostatic charge image developer of the exemplary embodiment including at least the yellow toner and the carrier. The yellow toner is stirred inside the developing apparatus 4Y so as to be friction-charged, and has charges with the same polarity (negative) as that of the charges charged on the photoreceptor 1Y so as to be held on the developer roll (developer holding member). In addition, the surface of the photoreceptor 1Y passes through the developing apparatus 4Y so that the yellow toner is electrostatically attached to a neutralized latent image portion on the surface of the photoreceptor 1Y, and the latent image is developed using the yellow toner. The photoreceptor 1Y on which the yellow toner image is formed subsequently runs at a predetermined rate, and the toner image developed on the photoreceptor 1Y is transported to the predetermined primary transfer position.

When the yellow toner image on the photoreceptor 1Y is transported to the primary transfer position, the primary transfer bias is applied to the primary transfer roller 5Y, an electrostatic force exerting from the photoreceptor 1Y to the primary transfer roller 5Y acts on the toner image, and the toner image on the photoreceptor 1Y is transferred to the intermediate transfer belt 20. At this time, the applied transfer bias has a (+) polarity that is the reverse polarity of the (−) polarity of the toner, and, for example, is controlled to approximately +10 μA in the first unit 10Y through the control portion, not shown.

Meanwhile, the remaining toner on the photoreceptor 1Y is removed and collected in the cleaning apparatus 6Y.

In addition, the primary transfer biases applied to the primary transfer rollers 5M, 5C, and 5K behind the second unit 10M are also controlled similarly to the first unit.

In the above manner, the intermediate transfer belt 20 to which the yellow toner image is transferred using the first unit 10Y is sequentially transported through the second to fourth units 10M, 10C, and 10K, and toner images of the respective colors are overlapped so as to be multiply transferred.

The intermediate transfer belt 20 in which four-color toner images are multiply transferred through the first to fourth units reaches a secondary transfer portion constituted by the intermediate transfer belt 20, the support roller 24 that is in contact with the inside surface of the intermediate transfer belt, and a secondary transfer roller (secondary transfer unit) 26 disposed on the image holding surface side of the intermediate transfer belt 20. On the other hand, recording paper (recording medium) P is supplied to a gap with which the secondary transfer roller 26 and the intermediate transfer belt 20 are pressed to come into contact through a supplying mechanism at a predetermined timing, and a secondary transfer bias is applied to the support roller 24. At this time, the applied transfer bias has a (−) polarity that is the same polarity as the (−) polarity of the toner, an electrostatic force exerting from the intermediate transfer belt 20 to the recording paper P acts on the toner image, and the toner image on the intermediate transfer belt 20 is transferred to the recording paper P. Further, the secondary transfer bias as this time is determined according to the resistance detected using a resistance detecting unit (not shown) that detects the resistance of the secondary transfer portion, and is voltage-controlled.

After that, the recording paper P is sent to the pressing portion (nipping portion) between a pair of fixing rollers in a fixing apparatus (roll-shaped fixing unit) 28, the toner image is heated, the color-overlapped toner image is melted, and fixed to the recording paper P.

Examples of the recording medium to which the toner image is transferred include plain paper, OHP sheets, and the like which are used in electrophotographic copy machine, printer, and the like.

The recording paper P to which the color image is completely fixed is transported to an ejection portion, and a series of color image forming operations are finished.

Meanwhile, the image forming apparatus in the above example is configured to transfer the toner image to the recording paper P through the intermediate transfer belt 20, but the configuration is not limited thereto, and a configuration may be employed in which the toner image is directly transferred to the recording paper from the photoreceptor.

Process Cartridge and Toner Cartridge

Figure 2:
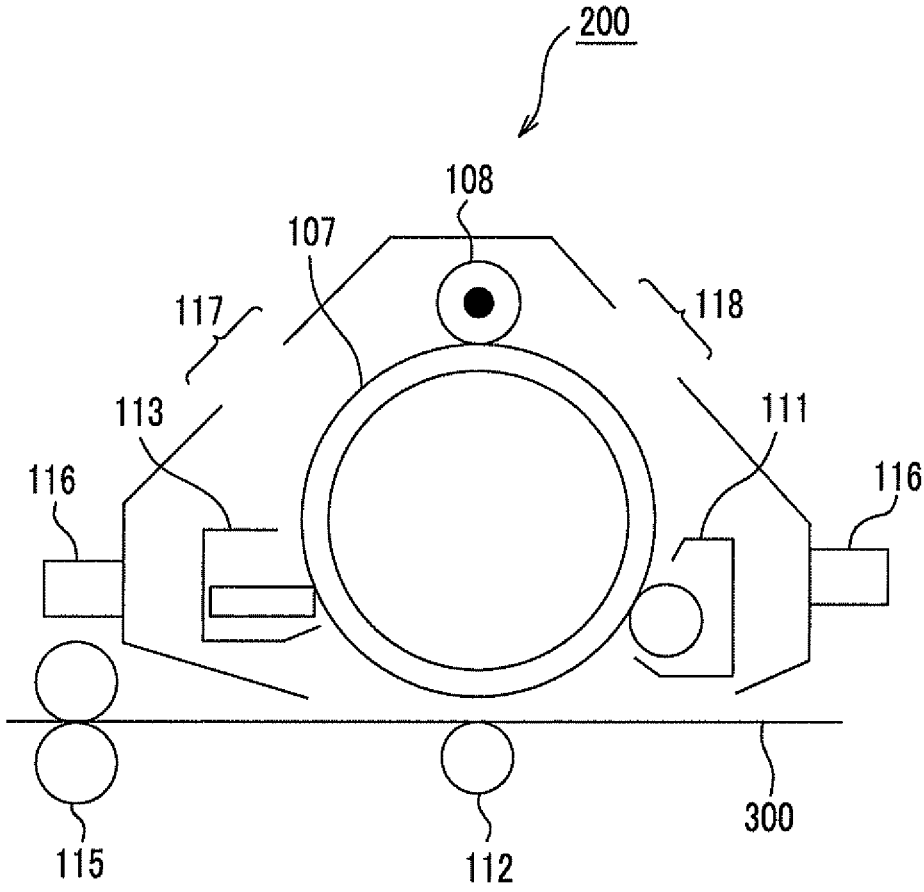
FIG. 2 is a schematic configuration view showing an example of a process cartridge of the exemplary embodiment.

FIG. 2 is a schematic configuration view showing a preferable example of the exemplary embodiment of a process cartridge that accommodates the electrostatic charge image developer of the exemplary embodiment. In a process cartridge 200, a charging roller 108, a developing apparatus 111, a photoreceptor cleaning apparatus 113, an opening portion 118 for exposure, and an opening portion 117 for erasing exposure are combined with a photoreceptor 107 using an attaching rail 116, and are integrated. Meanwhile, the reference signal 300 in FIG. 2 indicates the recording medium.

In addition, the process cartridge 200 is freely attachable to and detachable from the main body of the image forming apparatus constituted by a transfer apparatus 112, a fixing apparatus 115, and other not-shown components, and composes the image forming apparatus together with the main body of the image forming apparatus.

The process cartridge 200 shown in FIG. 2 has the charging roller 108, the developing apparatus 111, the photoreceptor cleaning apparatus 113, the opening portion 118 for exposure, and the opening portion 117 for erasing exposure, but these apparatuses may be selectively combined.

The process cartridge of the exemplary embodiment may have a developing unit (the developing apparatus 111 in FIG. 2), and preferably has at least one kind selected from a group consisting of the photoreceptor 107, the charging roller 108, the cleaning apparatus 113, the opening portion 118 for exposure, and the opening portion 117 for erasing exposure.

Next, the toner cartridge of the exemplary embodiment will be described. The toner cartridge of the exemplary embodiment is detachable from the image forming apparatus, and at least the electrostatic charge image developing toner of the exemplary embodiment is accommodated in the toner cartridge that accommodates a toner to be supplied to the developing apparatus provided in the image forming apparatus. Meanwhile, the toner cartridge of the exemplary embodiment may accommodate at least the toner, and may also accommodate, for example, a developer depending on the mechanism of the image forming apparatus.

Therefore, in the image forming apparatus having a configuration in which the toner cartridge is attachable and detachable, the electrostatic charge image developing toner of the exemplary embodiment is easily supplied to the developing apparatus by using the toner cartridge accommodating the electrostatic charge image developing toner of the exemplary embodiment.

Meanwhile, the image forming apparatus shown in FIG. 1 is an image forming apparatus having a configuration in which the toner cartridges 8Y, 8M, 8C, and 8K are attachable and detachable, and the developing apparatuses 4Y, 4M, 4C, and 4K are connected to the toner cartridges corresponding to the respective developing apparatus (colors) using toner supply pipes, not shown. In addition, in a case in which the toner cartridge accommodates a small amount of the toner, the toner cartridges are exchanged.

EXAMPLES

Hereinafter, the exemplary embodiment will be described more specifically in detail using Examples and Comparative Examples, but the exemplary embodiment is not limited to the following examples. Meanwhile, "parts" and "%" are all based on weight unless otherwise described.

Meanwhile, the particle diameters of the resin particles, the release agent particles, and the colorant are measured using a laser diffraction particle size distribution measurement apparatus (LA-700, manufactured by Horiba, Ltd.). As a measurement method, a sample in a dispersion liquid state is prepared so that the solid content becomes approximately 2 g, and ion exchange water is added to the sample so that approximately 40 ml of the solution is formed. The solution is put into a cell until an appropriate concentration, left to stand idle for approximately 2 minutes, and the particle diameter is measured when the concentration in the cell is almost stabilized. The volume average particle diameters of the respective obtained channels are accumulated from a smaller volume average particle diameter side, and a volume average particle diameter at which the cumulative value becomes 50% is used as the volume average particle diameter.

The softening temperature using a flow tester is obtained from a temperature that is equivalent to ½ of the height from the outflow start point to the end point when 1 $cm^3$ of the sample is melted and outflowed using an elevated flow tester [CFT-500] (manufactured by Shimatzu Corporation) under conditions of a diameter of the dice fine pore of 1 mm, a pressurization of 10 $kg/cm^2$, and a temperature-rise rate of 3° C./min.

Measurement of the Amount of the Alkaline Earth Metal

A toner (0.5 g) and a 10% solution of sodium dodexylbenzene sulfonate (5 g) are weighed and stirred with respect to 100 g of ultrapure water. The solution is dispersed over 20 minutes using a ultrasonic dispersing device adjusted to have a temperature of 30° C. The obtained dispersion liquid is filtered using a filter-equipped syringe, and the amount of calcium is quantitatively analyzed by measuring with a calibration curve sample having a known concentration. The amount of calcium is measured in the same manner for other alkaline earth metals.

Example 1

Synthesis of Amorphous Polyester Resin 1

Adduct of 2.2 mole of Bisphenol A ethyleneoxide: 40 mol %
Adduct of 2.2 mole of Bisphenol A propyleneoxide: 60 mol %
Terephthalic acid: 47 mol %
Fumaric acid: 40 mol %
Dodecenyl succinic anhydride: 15 mol %
Trimellitic anhydride: 3 mol %

The monomer components other than the fumaric acid and the trimellitic anhydride and 0.25 part of tin dioctanoate is put with respect to a total of 100 parts of the monomer components into a reaction vessel equipped with a stirring device, a thermometer, a condenser, and a nitrogen gas introduction pipe. After a reaction is caused for 6 hours at 235° C. under a nitrogen gas flow, the temperature of the reaction vessel is decreased to 200° C., the fumaric acid and the trimellitic anhydride are added, and reacted for 1 hour. The temperature is further increased to 220° C. over 4 hours, and polymerization is carried out under a pressure of 10 kPa so as to obtain a desired molecular weight, thereby obtaining a light yellow transparent amorphous polyester resin 1.

For the obtained amorphous polyester resin 1, the glass transition temperature Tg measured through DSC is 59° C., the weight average molecular weight Mw measured through GPC is 25,000, the number average molecular weight Mn is 7,000, the softening temperature measured using a flow tester is 107° C., and the acid value AV is 13 mg KOH/g.

Preparation of Amorphous Polyester Resin Dispersion Liquid 1

While a jacket-equipped 3 liter reaction tank (manufactured by Tokyo Rikakikai Co., Ltd., BJ-30N) having a condenser, a thermometer, a water dropping apparatus, and an anchor blade is maintained at 40° C. in a water circulation constant temperature tank, a solvent mixture of 160 parts of ethyl acetate and 100 parts of isopropyl alcohol is put into the reaction tank, 300 parts of the amorphous polyester resin 1 is added into the reaction tank, the solution is stirred at 150 rpm using a three-one motor, and dissolved, thereby obtaining an oil phase. An aqueous solution of 10% ammonia (14 parts) is added dropwise to the stirred oil phase over a dropping time of 5 minutes, the solution is mixed for 10 minutes, and then, furthermore, 900 parts of ion exchange water is added dropwise at a rate of 7 parts per minute so that the phase is reversed, thereby obtaining an emulsified liquid.

Immediately, 800 parts of the obtained emulsified liquid and 700 parts of ion exchange water are put into a 2 liter eggplant flask, and is set in an evaporator having a vacuum control unit (manufactured by Tokyo Rikakikai Co., Ltd.) through a trap sphere. While rotating the eggplant flask, the solution is heated in a hot bath at 60° C., and the pressure is reduced up to 7 kPa while being careful about bumping, thereby removing the solvent. The pressure is returned to a normal pressure at a point in time when the amount of the collected solvent becomes 1,100 parts, and the eggplant flask is cooled using water, thereby obtaining a dispersion liquid. There is no solvent oder in the obtained dispersion liquid. The volume average particle diameter D50 of the resin particles in the dispersion liquid is 130 nm. Meanwhile, in the following, the volume average particle diameter D50 is obtained from the average value of three measurement values obtained by removing the maximum value and the minimum value from five measurement values in a MICROTRACK.

After that, ion exchange water is added so that the solid content concentration becomes 20%, thereby preparing an amorphous polyester resin dispersion liquid 1.

Preparation of Release Agent Dispersion Liquid 1

Hydrocarbon wax (manufactured by Nippon Seiro Co., Ltd., trade name: FNP0080, melting temperature=80° C.): 270 parts
Anionic surfactant (manufactured by Dai-ichi Kogyo Seiyaku Co., Ltd., NEOGEN RK, amount of active ingredient: 60%): 13.5 parts (active ingredient at 3.0% with respect to the release agent)
Ion exchange water: 21.6 parts The above components are mixed, the release agent is dissolved at an internal liquid temperature of 120° C. using a pressure ejection-type homogenizer (manufactured by Gorlin Co., Ltd., Gorlin homogenizer), then, a dispersion treatment is carried out at a dispersion pressure of 5 MPa for 120 minutes and, subsequently, at 40 MPa for 360 minutes, and cooled, thereby obtaining a release agent dispersion liquid 1. The volume average particle diameter D50 of particles in the release agent dispersion liquid is 225 nm. After that, ion exchange water is added, and adjusted so that the solid content concentration becomes 20.0%.

Preparation of Black Pigment Dispersion Liquid 1

Carbon black (manufactured by Cabot Corporation, Regal 330): 250 parts

Anionic surfactant (manufactured by Dai-ichi Kogyo Seiyaku Co., Ltd., NEOGEN SC): 33 parts (active ingredient: 60%, 8% with respect to the colorant)

Ion exchange water: 750 parts

Ion exchange water (280 parts) and the anionic surfactant (33 parts) are put into a stainless vessel having a size in which the height of the liquid surface reaches approximately ⅓ of the height of the vessel when all of the above components are placed, the surfactant is sufficiently dissolved, then all of the solid content pigment is added, stirring is carried out using a stirring machine until all the pigments become wet, and defoaming is sufficiently carried out. The rest of the ion exchange water is added after the defoaming, the solution is dispersed for 10 minutes at 5000 rotations using a homogenizer (manufactured by TKA, ULTRA TURRAX T50), and stirring is carried out using a stirring machine for a day and night, thereby defoaming the solution. After the defoaming, the solution is, again, dispersed for 10 minutes at 6000 rotations using a homogenizer, then, stirring is carried out using a stirring machine for a day and night, thereby defoaming the solution. Subsequently, the dispersion liquid is dispersed at a pressure of 240 MPa using a high pressure impact-type dispersing device ALTIMIZER (manufactured by Sugino Machine Limited, HJP 30006). Dispersion is carried out 25 equivalent passes which are converted in consideration of the total preparation amount and the treatment capacity of the apparatus. The obtained dispersion liquid is left to stand idle for 72 hours so as to remove sediment, ion exchange water is added, and the solid content concentration is adjusted to 15%. The volume average particle diameter D50 of particles in the black pigment dispersion liquid 1 is 135 nm.

Synthesis of Crystalline Polyester Resin 1,10-dodecanedioic acid: 50 mol %

1,9-nonanediol: 50 mol %

The monomer components are put into a reaction vessel having a stirring device, a thermometer, a condenser, and a nitrogen gas introduction pipe, the inside of the reaction vessel is substituted using dry nitrogen gas, and 0.25 part of titanium tetrabutoxide (reagent) is added with respect to a total of 100 parts of the monomer components. After a stirring reaction is caused for 3 hours at 170° C. under a nitrogen gas flow, the temperature of the reaction vessel is further increased to 210° C. over 1 hour, the inside of the reaction vessel is depressurized to 3 kPa, and a stirring reaction is caused for 13 hours under depressurization, thereby obtaining a crystalline polyester resin.

For the obtained crystalline polyester resin, the melting temperature measured through DSC is 73.6° C., the weight average molecular weight Mw measured through GPC is 25,000, the number average molecular weight Mn is 10,500, and the acid value AV is 10.1 mg KOH/g.

Preparation of Crystalline Polyester Resin Dispersion Liquid

The crystalline polyester resin (300 parts), methyl ethyl ketone (solvent, 160 parts), and isopropyl alcohol (solvent, 100 parts) are put into a jacket-equipped 3 liter reaction tank (manufactured by Tokyo Rikakikai Co., Ltd., BJ-30N) having a condenser, a thermometer, a water dropping apparatus, and an anchor blade, stirred and mixed at 100 rpm while being maintained at 70° C. in a water circulation constant temperature tank, thereby dissolving the resin (dissolution liquid preparing process).

After the stirring, the rotation number is set to 150 rpm, the water circulation constant temperature tank is set to 66° C., 17 parts of 10% ammonia water (reagent) is added over 10 minutes, a total of 900 parts of ion exchange water maintained at 66° C. is added dropwise at a rate of 7 parts/min so as to reverse the phase, thereby obtaining an emulsified liquid.

Immediately, 800 parts of the obtained emulsified liquid and 700 parts of ion exchange water are put into a 2 liter eggplant flask, and is set in an evaporator having a vacuum control unit (manufactured by Tokyo Rikakikai Co., Ltd.) through a trap sphere. While rotating the eggplant flask, the solution is heated in a hot bath at 60° C., and the pressure is reduced up to 7 kPa while being careful about bumping, thereby removing the solvent. The pressure is returned to a normal pressure at a point in time when the amount of the collected solvent becomes 1,100 parts, and the eggplant flask is cooled using water, thereby obtaining a dispersion liquid. There is no solvent oder in the obtained dispersion liquid. The volume average particle diameter D50 of the resin particles in the dispersion liquid is 130 nm. After that, ion exchange water is added so that the solid content concentration becomes 20%, thereby preparing a crystalline polyester resin dispersion liquid.

Preparation of an Aqueous Solution of Aluminum Sulfate

Aluminum sulfate powder (manufactured by Asada Chemical Industry Co., Ltd., 17% aluminum sulfate): 35 parts Ion exchange water: 1,965 parts The above components are put into a 2 liter vessel, stirred and mixed at 30° C. until sediment is lost, thereby preparing an aqueous solution of aluminum sulfate.

Preparation of Toner

Amorphous polyester resin dispersion liquid 1: 700 parts

Black pigment dispersion liquid 1: 133 parts

Release agent dispersion liquid 1: 100 parts

Crystalline polyester resin dispersion liquid: 50 parts

Ion exchange water: 350 parts

Anionic surfactant (manufactured by Dow Chemical Company, Dowfax 2A1): 2.9 parts The above components are put into a 3 liter reaction vessel equipped with a thermometer, a pH meter, and a stirring device, 1.0% nitric acid is added at a temperature of 25° C. so as to obtain a pH of 3.0, and then, while dispersing the solution at 5,000 rpm using a homogenizer (manufactured by IKA Japan, ULTRA TRAX T50), 130 parts of the prepared aqueous solution of aluminum sulfate is added, thereby dispersing the components for 6 minutes.

After that, a stirring device and a mantle heater are installed on the reaction vessel, the temperature is increased at a temperature-rise rate of 0.2° C./minute up to a temperature of 40° C. and at 0.05° C./minute from higher than 40° C. while the rotation number of the stirring device is adjusted so that the slurry is sufficiently stirred, and the particle diameter is measured using a MULTISIZER II (an aperture diameter: 50 μm, manufactured by Beckman Coulter) every 10 minutes. The temperature is maintained when the volume average particle diameter becomes 5.0 μm, and 50 parts of the amorphous polyester resin dispersion liquid 1 is added over 5 minutes.

After holding the solution for 30 minutes, the pH is adjusted to be 9.0 using an aqueous solution of 1% sodium hydroxide. After that, while the pH is adjusted in the same manner so as to be 9.0 every 5° C., the temperature is increased up to 90° C. at a temperature-rise rate of 1° C./minute, and held at 98° C. Since it is confirmed in an observation of particle shapes and surface properties using an optical microscope and a scanning electronic microscope (FE-SEM) that the particles are coalesced after 10.0 hours, the vessel is cooled up to 30° C. over 5 minutes using cooling water.

The cooled slurry is made to pass through a nylon mesh having an aperture of 15 μm so as to remove coarse powder, and the toner slurry that has passed through the mesh is filtered under depressurization using an aspirator. The toner remaining on a filter paper is pulverized to be as fine as possible with hands, put into ion exchange water at an amount that is 10 times the amount of the toner at a temperature of 30° C., stirred, and mixed for 30 minutes, an 1% aqueous solution of calcium chloride is added so that the amount of calcium chloride becomes 0.5% with respect to the weight of the toner, furthermore, stirred and mixed for 30 minutes. Subsequently, the solution is, again, filtered under depressurization using the aspirator, the toner remaining on the filter paper is pulverized, ion exchange water is added at an amount that is 10 times the amount of the toner at a temperature of 30° C., stirred, and mixed for 30 minutes, then, again, filtered under depressurization using the aspirator, and the electrical conductivity of the filtrate is measured. The above operation is repeated until the electrical conductivity of the filtrate becomes 10 μS/cm or less, thereby washing the toner.

The washed toner is pulverized to be fine using a wet and dry-type granulator (co-mill), and then dried under vacuum for 36 hours in an oven at 35° C., thereby obtaining toner particles. Hydrophobic silica (manufactured by Nippon Aerosil Co., Ltd., RY200S, 1.0 part) is added to 100 parts of the obtained toner particles, mixed, and blended at 13,000 rpm for 30 seconds using a sample mill. After that, the mixture is sieved using a vibration sieve having an aperture of 45 μm, thereby obtaining a black toner (toner 1).

For the obtained black toner, the volume average particle diameter D50 is 6.0 μm, the shape factor is 0.960 (manufactured by Sysmex Corporation, FPIA-3000). Meanwhile, an observation of the SEM image of the toner shows that the toner has a smooth surface, and defects, such as extrusion of the release agent or peeling of the surface layer, are not observed.

The amount of calcium which is detected through ion chromatography is $1.00\times10^{-8}$ mol/g.

Manufacturing of Carrier

Ferrite particles (volume average particle diameter: 35 μm): 100 parts

Toluene: 14 parts

Perfluorooctylethyl acrylate-methyl methacrylate copolymer (copolymer rate=2:8, weight average molecular weight: 77000): 2.0 parts Carbon black (trade name: VXC-72, manufactured by Cabot Corporation, volume resistivity: 100 Ωcm or less): 0.12 part Firstly, carbon black is diluted in toluene, added to a perfluorooctylethyl acrylate methyl methacrylate copolymer, and dispersed using a sand mill, thereby preparing a coating layer forming liquid. Next, the coating layer forming liquid and ferrite particles are put into a vacuum deairing kneader, stirred for 30 minutes at a temperature of 60° C., then, depressurized, and the toluene is distilled so as to form a resin-coating layer, thereby obtaining a carrier.

Manufacturing of Developer

The toner 1 (36 parts) and the carrier (414 parts) are put into a 2 liter V blender, stirred for 20 minutes, and then sieved using a mesh of 212 μm, thereby manufacturing a developer.

Evaluation

—Evaluation of the Charge Amount and the Charge Environment Dependency—

A developer prepared in the above manner is set in a charging evaluation tool reformed by removing the developing machine portion of a DocucentreColor 4300 manufactured by Fuji Xerox Co., Ltd. so that only the developing machine portion drives, the humidity is adjusted for one night under the respective environments of a high temperature and a high humidity (28° C. 85% RH) and a low temperature and a low humidity (10° C. 15% RH), then, the charging evaluation tool is driven for 30 minutes so as to charge the developer, thereby obtaining a sample, and then the charge is measured by a blow-off tribo method. In addition, the charge amount is expressed by the ratio of a high temperature and high humidity environment/a low temperature and low humidity environment, and used as the charge environment dependency. The obtained results are shown in Table 1.

Image Density Unevenness

After a developer prepared in the above manner is set in a DocucentreColor 4300 manufactured by Fuji Xerox Co., Ltd., and the humidity is adjusted for one night under the respective environments of a high temperature and a high humidity (28° C. 85% RH) and a low temperature and a low humidity (10° C. 15% RH), 10000 sheets of an image having an image density of 2.5% are outputted under the same environments, then an image having an image density of 80% is outputted, the image density is measured at 5 points in the image using a X-rite 938, and the average image density and the standard deviation are calculated. The obtained results are shown in Table 1. Image densities of 1.40 or more are evaluated to be favorable, and standard deviations of 0.03 or less are evaluated to be favorable.

Example 2

A black toner (toner 2) is obtained in the same order as in Example 1 except that the 1% aqueous solution of calcium chloride, which is used in Example 1, is added so that the amount of calcium chloride becomes 0.01% of the weight of the toner.

The amount of the alkaline earth metal which is detected through ion chromatography is $1.00\times10^{-10}$ mol/g.

The toner 2 is evaluated in the same manner as in Example 1. The obtained results are shown in Table 1.

Example 3

A black toner (toner 3) is obtained in the same order as in Example 1 except that the 1% aqueous solution of calcium chloride, which is used in Example 1, is added so that the amount of calcium chloride becomes 10% of the weight of the toner.

The amount of the alkaline earth metal which is detected through ion chromatography is $0.90\times10^{-6}$ mol/g.

The toner 3 is evaluated in the same manner as in Example 1. The obtained results are shown in Table 1.

Example 4

A black toner (toner 4) is obtained in the same order as in Example 1 except that the 1% aqueous solution of calcium chloride, which is used in Example 1, is changed into an 1% aqueous solution of barium chloride.

The amount of the alkaline earth metal which is detected through ion chromatography is $1.00\times10^{-8}$ mol/g.

The toner 4 is evaluated in the same manner as in Example 1. The obtained results are shown in Table 1.

Example 5

A black toner (toner 5) is obtained in the same order as in Example 1 except that the 1% aqueous solution of calcium chloride, which is used in Example 1, is changed into a 1% aqueous solution of strontium chloride.

The amount of the alkaline earth metal which is detected through ion chromatography is $1.00\times10^{-8}$ mol/g.

The toner 5 is evaluated in the same manner as in Example 1. The obtained results are shown in Table 1.

Comparative Example 1

A black toner (toner 6) is obtained in the same order as in Example 1 except that the 1% aqueous solution of calcium chloride, which is used in Example 1, is changed to be added so that the amount of calcium chloride becomes 30% of the weight of the toner.

The amount of the alkaline earth metal which is detected through ion chromatography is $1.00\times10^{-6}$ mol/g.

The toner 6 is evaluated in the same manner as in Example 1. The obtained results are shown in Table 1.

Comparative Example 2

A black toner (toner 7) is obtained in the same order as in Example 1 except that the 1% aqueous solution of calcium chloride, which is used in Example 1, is changed to be added so that the amount of calcium chloride becomes 0.005% of the weight of the toner.

The amount of the alkaline earth metal which is detected through ion chromatography of the toner particles is $0.90\times10^{-10}$ mol/g.

The toner 7 is evaluated in the same manner as in Example 1. The obtained results are shown in Table 1.

Preparation of Cyan Pigment Dispersion Liquid 1

C. I. Pigment Blue 15:3 (manufactured by Dainichiseika Color & Chemicals Mfg. Co., Ltd., ECB 301): 200 parts Anionic surfactant (manufactured by Dai-ichi Kogyo Seiyaku Co., Ltd., NEOGEN SC): 33 parts (active ingredient: 60%, 10% with respect to the colorant)

Ion exchange water: 750 parts

Ion exchange water (280 parts) and the anionic surfactant (33 parts) are put into a stainless vessel having a size in which the height of the liquid surface reaches approximately ⅓ of the height of the vessel when all of the above components are placed, the surfactant is sufficiently dissolved, then all of the solid content pigment is added, stirring is carried out using a stirring machine until all the pigments become wet, and defoaming is sufficiently carried out. The rest of the ion exchange water is added after the defoaming, the solution is dispersed for 10 minutes at 5000 rotations using a homogenizer (manufactured by TKA, ULTRA TURRAX T50), and stirring is carried out using a stirring machine for one night, thereby defoaming the solution. After the defoaming, the solution is, again, dispersed for 10 minutes at 6000 rotations using a homogenizer, then, stirring is carried out using a stirring machine for one night, thereby defoaming the solution. Subsequently, the dispersion liquid is dispersed at a pressure of 240 MPa using a high pressure impact-type dispersing device ALTIMIZER (manufactured by Sugino Machine Limited, HJP 30006). Dispersion is carried out 25 equivalent passes which are converted in consideration of the total preparation amount and the treatment capacity of the apparatus. The obtained dispersion liquid is left to stand idle for 72 hours so as to remove sediment, ion exchange water is added, and the solid content concentration is adjusted to 15%. The volume average particle diameter D50 of particles in the cyan pigment dispersion liquid 1 is 135 nm.

Example 6

Preparation of Toner

Amorphous polyester resin dispersion liquid 1: 700 parts

Cyan pigment dispersion liquid 1: 133 parts

Release agent dispersion liquid 1: 100 parts

Crystalline polyester resin dispersion liquid: 50 parts

Ion exchange water: 350 parts

Anionic surfactant (manufactured by Dow Chemical Company, Dowfax 2A1): 2.9 parts

TABLE 1

| | Amount of alkaline earth metal salt (Chloride) (%) | Amount of alkaline earth metal (mol/g) | Kind of alkaline earth metals | Charge amount μC/g (high temperature and high humidity environment) | Charge amount μC/g (low temperature and low humidity environment) | Charge environment dependency | Average image densities at 5 places in an image (high temperature and high humidity environment) | Standard deviation in image densities at 5 places in an image (high temperature and high humidity environment) | Average image densities at 5 places in an image (low temperature and low humidity environment) | Standard deviation in image densities at 5 places in an image (low temperature and low humidity environment) |
|---|---|---|---|---|---|---|---|---|---|---|
| Example 1 | 0.5 | $1.00\times10^{-8}$ | Calcium | 80 | 100 | 0.80 | 1.43 | 0.022 | 1.42 | 0.019 |
| Example 2 | 0.01 | $1.00\times10^{-10}$ | Calcium | 85 | 121 | 0.70 | 1.42 | 0.039 | 1.40 | 0.029 |
| Example 3 | 10 | $0.90\times10^{-6}$ | Calcium | 75 | 103 | 0.73 | 1.44 | 0.037 | 1.42 | 0.030 |
| Example 4 | 0.5 | $1.00\times10^{-8}$ | Barium | 81 | 103 | 0.79 | 1.44 | 0.024 | 1.41 | 0.02 |
| Example 5 | 0.5 | $1.00\times10^{-8}$ | Strontium | 83 | 106 | 0.78 | 1.41 | 0.021 | 1.39 | 0.021 |
| Comparative example 1 | 30 | $1.00\times10^{-6}$ | Calcium | 45 | 55 | 0.82 | 1.5 | 0.062 | 1.45 | 0.05 |
| Comparative example 2 | 0.005 | $0.90\times10^{-10}$ | Calcium | 86 | 170 | 0.51 | 1.38 | 0.049 | 1.4 | 0.045 |

The above components are put into a 3 liter reaction vessel equipped with a thermometer, a pH meter, and a stirring device, 1.0% nitric acid is added at a temperature of 25° C. so as to obtain a pH of 3.0, and then, while dispersing the solution at 5,000 rpm using a homogenizer (manufactured by IRA Japan, ULTRA TRAX T50), 130 parts of the prepared aqueous solution of aluminum sulfate is added, thereby dispersing the components for 6 minutes.

After that, a stirring device and a mantle heater are installed in the reaction vessel, the temperature is increased at a temperature-rise rate of 0.2° C./minute up to a temperature of 40° C. and at 0.05° C./minute from higher than 40° C. while the rotation number of the stirring device is adjusted so that the slurry is sufficiently stirred, and the particle diameter is measured using a MULTISIZER II (an aperture diameter: 50 μm, manufactured by Beckman Coulter) every 10 minutes. The temperature is maintained when the volume average particle diameter becomes 5.0 μm, and 50 parts of the amorphous polyester resin dispersion liquid 1 is added over 5 minutes.

After holding the solution for 30 minutes, the pH is adjusted to be 9.0 using an aqueous solution of 1% sodium hydroxide. After that, while the pH is adjusted in the same manner so as to be 9.0 every 5° C., the temperature is increased up to 90° C. at a temperature-rise rate of 1° C./minute, and held at 98° C. Since it is confirmed in an observation of particle shapes and surface properties using an optical microscope and a scanning electronic microscope (FE-SEM) that the particles are coalesced after 10.0 hours, the vessel is cooled up to 30° C. over 5 minutes using cooling water.

The cooled slurry is made to pass through a nylon mesh having an aperture of 15 μm so as to remove coarse powder, and the toner slurry that has passed through the mesh is filtered under depressurization using an aspirator. The toner remaining on a filter paper is pulverized, added into ion exchange water of an amount that is 10 times the amount of the toner at a temperature of 30° C., stirred, and mixed for 30 minutes, an 1% aqueous solution of calcium chloride is added so that the amount of calcium chloride becomes 0.5% with respect to the weight of the toner, furthermore, stirred and mixed for 30 minutes. Subsequently, the solution is, again, filtered under depressurization using the aspirator, the toner remaining on the filter paper is pulverized, added into ion exchange water of an amount that is 10 times the amount of the toner at a temperature of 30° C., stirred, and mixed for 30 minutes, then, again, filtered under depressurization using the aspirator, and the electrical conductivity of the filtrate is measured. The above operation is repeated 8 times until the electrical conductivity of the filtrate becomes 10 μS/cm or less, thereby washing the toner.

The washed toner is finely pulverized using a wet-type granulator (co-mill), and then dried under vacuum for 36 hours in an oven at 35° C., thereby obtaining toner particles.

Hydrophobic silica (manufactured by Nippon Aerosil Co., Ltd., RY200S, 1.0 part) is added to 100 parts of the obtained toner particles, and mixed at a circumferential velocity of 30 m/sec for 2 minutes using a Henschel mixer. After that, the mixture is sieved using a vibration sieve having an aperture of 45 μm, thereby obtaining a cyan toner. In addition, the average particle diameter of the external additive is 16 nm.

For the obtained black toner, the volume average particle diameter D50 is 6.0 μm, the shape factor is 0.960 (manufactured by Sysmex Corporation, FPIA-3000). Meanwhile, an observation of the SEM image of the toner shows that the toner has a smooth surface, and defects, such as extrusion of the release agent or peeling of the surface layer, are not observed.

The amount of calcium which is detected through ion chromatography is $1.0\times10^{-8}$ mol/g.

Manufacturing of Carrier

Ferrite particles (volume average particle diameter: 35 μm): 100 parts

Toluene: 14 parts

Perfluorooctylethyl acrylate-methyl methacrylate copolymer (copolymer rate=2:8, weight average molecular weight: 77000): 2.0 parts Carbon black (trade name: VXC-72, manufactured by Cabot Corporation, volume resistivity: 100 Ωcm or less): 0.12 part Firstly, carbon black is diluted in toluene, added to a perfluorooctylethyl acrylate-methyl methacrylate copolymer, and dispersed using a sand mill, thereby preparing a coating layer forming liquid. Next, the coating layer forming liquid and ferrite particles are put into a vacuum deairing kneader, stirred for 30 minutes at a temperature of 60° C., then, depressurized, and the toluene is distilled so as to form a resin-coating layer, thereby obtaining a carrier.

Manufacturing of Developer

The toner (36 parts) and the carrier (414 parts) are put into a 2 liter V blender, stirred for 20 minutes, and then sieved using a mesh of 212 μm, thereby manufacturing a developer.

Example 7

A cyan toner is obtained in the same manner except that the amount of calcium chloride being added is changed so that the amount of calcium chloride becomes 0.01% of the weight of the toner in Example 6.

The amount of the alkaline earth metal which is detected through ion chromatography is $1.0\times10^{-10}$ mol/g.

Using the obtained toner, a developer is prepared in the same manner in Example 6.

Example 8

A cyan toner is obtained in the same manner except that the amount of calcium chloride being added is changed so that the amount of calcium chloride becomes 10% of the weight of the toner in Example 6.

The amount of the calcium which is detected through ion chromatography is $0.9\times10^{-6}$ mol/g.

Using the obtained toner, a developer is prepared in the same manner in Example 6.

Example 9

A cyan toner is obtained in the same manner except that the external additive is changed into hydrophobic silica (manufactured by Nippon Aerosil Co., Ltd., NY50) in Example 6. In addition, the average particle diameter of the external additive is 30 nm.

The amount of the calcium which is detected through ion chromatography is $1.0\times10^{-8}$ mol/g.

Using the obtained toner, a developer is prepared in the same manner in Example 6.

Example 10

A cyan toner is obtained in the same manner except that the external additive is changed into hydrophobic silica (manufactured by Nippon Aerosil Co., Ltd., R805) in Example 6. In addition, the average particle diameter of the external additive is 10 nm.

The amount of the calcium which is detected through ion chromatography is $1.0\times10^{-8}$ mol/g.

Using the obtained toner, a developer is prepared in the same manner in Example 6.

Example 11

A cyan toner is obtained in the same manner except that the external additive is changed into hydrophobic silica (manufactured by Nippon Aerosil Co., Ltd., NY50) in Example 7. In addition, the average particle diameter of the external additive is 30 nm.

The amount of the calcium which is detected through ion chromatography is $1.0\times10^{-10}$ mol/g.

Using the obtained toner, a developer is prepared in the same manner in Example 6.

Example 12

A cyan toner is obtained in the same manner except that calcium chloride being added is changed into calcium hydroxide in Example 6.

The amount of the calcium which is detected through ion chromatography is $1.0\times10^{-8}$ mol/g.

Using the obtained toner, a developer is prepared in the same manner in Example 6.

Example 13

A cyan toner is obtained in the same manner except that the external additive of hydrophobic silica (manufactured by Nippon Aerosil Co., Ltd., RY200S, 1.0 part) is changed into 1.0 part of hydrophobic silica (manufactured by Nippon. Aerosil Co., Ltd., RY200S) and 0.5 part of hydrophobic silica (manufactured by Nippon Aerosil Co., Ltd., RY50) in Example 6.

The amount of the calcium which is detected through ion chromatography is $1.0\times10^{-8}$ mol/g.

Using the obtained toner, a developer is prepared in the same manner in Example 6.

Comparative Example 3

A cyan toner is obtained in the same manner except that the amount of calcium chloride being added is changed so that the amount of calcium chloride becomes 30% of the weight of the toner in Example 6.

The amount of the calcium which is detected through ion chromatography is $1.0\times10^{-6}$ mol/g.

Using the obtained toner, a developer is prepared in the same manner in Example 6.

Comparative Example 4

A cyan toner is obtained in the same manner except that the amount of calcium chloride being added is changed so that the amount of calcium chloride becomes 0.005% of the weight of the toner in Example 6.

The amount of the calcium which is detected through ion chromatography is $0.9\times10^{-10}$ mol/g.

Using the obtained toner, a developer is prepared in the same manner in Example 6.

Evaluation of the Fluidity of the Toner

The fluidity of the toner is evaluated by the above method using a powder rheometer. The results are shown in Table 2.

Evaluation of the Density Unevenness of Images

After the respective developers of Examples and Comparative examples obtained by the above method are accommodated in a reformed DocuPrint C1616 (manufactured by Fuji Xerox Co., Ltd.), and left to stand idle for one week under an air temperature of 20° C. and a humidity of 15 RH %, evaluation is carried out under an environment of an air temperature of 28° C. and a humidity of 80%.

An image having an image density of 100% is outputted on A4 paper (P paper, manufactured by Fuji Xerox Co., Ltd.), 100 sheets are printed, and then the density unevenness is evaluated by the following evaluation method.

Density Unevenness

The image density is measured using a X-rite 939. The image densities are measured at randomly selected 10 points, the difference between the maximum value and the minimum value is obtained, and a density unevenness is obtained.

TABLE 2

| | Amount of calcium (mol/g) | Particle diameter of external additive (μm) | Evaluation | |
|---|---|---|---|---|
| | | | Fluidity | Density unevenness |
| Example 6 | $1.0\times10^{-8}$ | 16 | 600 | 0.03 |
| Example 7 | $1.0\times10^{-10}$ | 16 | 300 | 0.08 |
| Example 8 | $0.9\times10^{-6}$ | 16 | 300 | 0.08 |
| Example 9 | $1.0\times10^{-8}$ | 30 | 500 | 0.07 |
| Example 10 | $1.0\times10^{-8}$ | 10 | 700 | 0.05 |
| Example 11 | $1.0\times10^{-10}$ | 30 | 250 | 0.09 |
| Example 12 | $1.0\times10^{-8}$ | 16 | 610 | 0.03 |
| Example 13 | $1.0\times10^{-8}$ | 30 | 480 | 0.08 |
| Comparative example 3 | $1.0\times10^{-6}$ | 16 | 200 | 0.15 |
| Comparative example 4 | $0.9\times10^{-10}$ | 16 | 200 | 0.15 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. An electrostatic charge image developing toner comprising:

toner particles that contain a binder resin having a carboxyl group, wherein the carboxyl group in the binder resin that is present on surfaces of the toner particles forms an alkaline earth metal salt, and an amount of the alkaline earth metal which is detected through ion chromatography of the toner particles is in a range of from $1.00\times10^{-10}$ mol/g to $0.90\times10^{-6}$ mol/g, and the binder resin contains an amorphous polyester resin having a dodecenyl group.

2. The electrostatic charge image developing toner according to claim 1, wherein the amount of the alkaline earth metal is in a range of from $1.00\times10^{-9}$ mol/g to $0.50\times10^{-6}$ mol/g.

3. The electrostatic charge image developing toner according to claim 1, wherein a main component of the alkaline earth metal is calcium.

4. The electrostatic charge image developing toner according to claim 2, wherein a main component of the alkaline earth metal is calcium.

5. The electrostatic charge image developing toner according to claim 1, wherein the binder resin further contains a crystalline polyester.

6. The electrostatic charge image developing toner according to claim 1, further comprising an external additive having a primary particle diameter of from 10 nm to 30 nm.

7. The electrostatic charge image developing toner according to claim 2, further comprising an external additive having a primary particle diameter of from 10 nm to 30 nm.

8. An electrostatic charge image developer comprising the electrostatic charge image developing toner according to claim 1.

9. The electrostatic charge image developer according to claim 8, wherein a main component of the alkaline earth metal in the toner is calcium.

10. A toner cartridge comprising:

a chamber that contains the electrostatic charge image developing toner according to claim 1.

11. The toner cartridge according to claim 10, wherein a main component of the alkaline earth metal in the toner is calcium.

12. A process cartridge for an image forming apparatus, comprising:

a developing unit that contains the electrostatic charge image developer according to claim 8 and develops an electrostatic charge image formed on a surface of an electrostatic charge image holding member using the electrostatic charge image developer to form a toner image, wherein the process cartridge is detachable from the image forming apparatus.

13. The process cartridge for an image forming apparatus according to claim 12, wherein a main component of the alkaline earth metal in the toner is calcium.

14. An image forming apparatus comprising:

an electrostatic charge image holding member;

a charging unit that charges a surface of the electrostatic charge image holding member;

an electrostatic charge image forming unit that forms an electrostatic charge image on the surface of a charged electrostatic charge image holding member;

a developing unit that contains the electrostatic charge image developer according to claim 8 and develops the electrostatic charge image formed on the surface of the electrostatic charge image holding member using the electrostatic charge image developer to form a toner image;

a transfer unit that transfers the toner image onto a recording medium; and a fixing unit that fixes the transferred toner image onto the recording medium.

15. The image forming apparatus according to claim 14, wherein a main component of the alkaline earth metal in the toner is calcium.

16. An image forming method comprising:

charging a surface of an electrostatic charge image holding member;

forming an electrostatic charge image on the surface of a charged electrostatic charge image holding member;

developing the electrostatic charge image formed on the surface of the electrostatic charge image holding member using the electrostatic charge image developer according to claim 8 to form a toner image;

transferring the toner image onto a recording medium; and fixing the transferred toner image onto the recording medium.

17. The image forming method according to claim 16, wherein a main component of the alkaline earth metal in the toner is calcium.

18. The electrostatic charge image developing toner according to claim 1, wherein the binder resin further contains a crystalline polyester that is a reaction product of a polyvalent carboxylic acid and a fatty diol having from 7 to 20 carbon atoms in a main chain.

19. The electrostatic charge image developing toner according to claim 1, wherein the amorphous polyester is a reaction product of a polyvalent carboxylic acid and a polyol, and a portion of the polyvalent carboxylic acid is a dicarboxylic acid having a sulfonic acid group.

* * * * *